US010131140B2

(12) United States Patent
Kobayashi et al.

(10) Patent No.: US 10,131,140 B2
(45) Date of Patent: Nov. 20, 2018

(54) INKJET TYPE IMAGE FORMING APPARATUS HAVING STORAGE CHAMBER STORING INK AND SWITCH PORTION SWITCHING STATE OF COMMUNICATION BETWEEN THE STORAGE CHAMBER AND ATMOSPHERE

(71) Applicant: BROTHER KOGYO KABUSHIKI KAISHA, Nagoya-shi, Aichi-ken (JP)

(72) Inventors: Akihito Kobayashi, Konan (JP); Akinari Ishibe, Okazaki (JP); Yuma Tanabe, Nagoya (JP); Masahiro Hayashi, Nagoya (JP); Masatake Sato, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/719,841

(22) Filed: Sep. 29, 2017

(65) Prior Publication Data

US 2018/0178512 A1 Jun. 28, 2018

(30) Foreign Application Priority Data

Dec. 28, 2016 (JP) ..... 2016-256714

(51) Int. Cl.
*B41J 2/045* (2006.01)
*B41J 2/175* (2006.01)

(52) U.S. Cl.
CPC ..... *B41J 2/04553* (2013.01); *B41J 2/04566* (2013.01); *B41J 2/04586* (2013.01); *B41J 2/17553* (2013.01)

(58) Field of Classification Search
CPC ..... B41J 2/04553; B41J 2/04566; B41J 2/04586; B41J 2/0455; B41J 2/04551
See application file for complete search history.

(56) References Cited

U.S. PATENT DOCUMENTS

2009/0122121 A1* 5/2009 Kawasaki ..... B41J 2/17513 347/85
2009/0201351 A1 8/2009 Shimizu et al.
2015/0091956 A1* 4/2015 Akiyama ..... B41J 2/17596 347/6

FOREIGN PATENT DOCUMENTS

JP 2008-230162 A 10/2008
JP 2008-238792 A 10/2008

* cited by examiner

*Primary Examiner* — Thinh H Nguyen
(74) *Attorney, Agent, or Firm* — Merchant & Gould P.C.

(57) ABSTRACT

In an inkjet type image forming apparatus, a cartridge includes a first storage chamber and a first fluid communication portion. The first air communication portion allows the first storage chamber to be in communication with an atmosphere. A second storage chamber stores the ink supplied from the first storage chamber by hydraulic head difference. The switch portion switches a state of the second air communication portion between a first state in which the second storage chamber communicates with the atmosphere and a second state in which an amount of air flow between the second storage chamber and the atmosphere is smaller than that in the first state. The controller controls the switch portion to switch the state of the second air communication portion from the first state to the second state. After the recording process, the controller controls the switch portion to switch the state to the first state.

12 Claims, 13 Drawing Sheets

INKJET TYPE IMAGE FORMING APPARATUS HAVING STORAGE CHAMBER STORING INK AND SWITCH PORTION SWITCHING STATE OF COMMUNICATION BETWEEN THE STORAGE CHAMBER AND ATMOSPHERE

CROSS REFERENCE TO RELATED APPLICATION

This application claims priority from Japanese Patent Application No. 2016-256714 filed on Dec. 28, 2016. The entire content of the priority application is incorporated herein by reference.

TECHNICAL FIELD

The present disclosure relates to an inkjet type image forming apparatus configured to eject ink stored in a detachably mounted cartridge to form an image on a recording sheet.

BACKGROUND

Japanese Patent Application Publication Nos. 2008-230162 and 2008-238792 disclose an ink jet recording device including a cartridge storing therein ink, an attachment portion to which the cartridge is attached and from which the cartridge is detached, a sub-tank storing ink supplied from the cartridge attached to the attachment portion, and a recording portion ejecting ink stored in the sub-tank to form an image on an image recording medium.

The cartridge and the sub-tank are communicated with an atmosphere. Therefore, level of ink stored in the cartridge is equal to that stored in the sub-tank at least during a state where the recording portion does not eject ink, because ink can be moved between the cartridge and the sub-tank due to hydraulic head difference.

SUMMARY

According to the above-described ink jet recording device, in an ink passage from the cartridge to the recording portion, a portion of the ink passage located in the accommodating portion generally provides a passage resistance higher than that in a remaining portion of the ink passage. Therefore, during ink ejection from the recording portion, amount of ink flowing from the sub-tank into the recording portion is greater than an amount of ink flowing form the cartridge into the sub-tank. In other words, level of ink in the sub-tank becomes lower than that in the cartridge. This phenomenon may incur the following problems.

As an example, in a case where a residual amount sensor for detecting residual amount of ink is provided in the sub-tank, erroneous detection may occur such that the residual amount of ink becomes lower than a threshold level (hereinafter, simply referred to as "near empty") in spite of the fact that the ink still remains in the cartridge. As another example, in a case where the residual amount sensor is provided in the cartridge, the sensor may not detect "near empty" irrespective of the fact that ink in the sub-tank is almost empty. Further, in the latter case, air may be mixed in the ink supplied to the recording portion to degrade imaging quality, if the level of ink in the sub-tank becomes lower than an ink outlet port.

In view of the foregoing, it is an object of the disclosure to provide an inkjet type image forming apparatus provided with a first storage chamber in a cartridge and a second storage chamber in a device body so that the inkjet type image forming apparatus is capable of restraining eccentric reduction in ink level in the second storage chamber during ink ejection.

In order to attain the above and other objects, the disclosure provides an inkjet type image forming apparatus. The inkjet type image forming apparatus includes a cartridge, a cartridge attachment portion, a switch portion, a recording portion, and a controller. The cartridge includes a first storage chamber, a first fluid communication portion, and a supply portion. The first storage chamber is configured to store ink. The first air communication portion allows the first storage chamber to be in fluid communication with an atmosphere. The supply portion is configured to supply the ink stored in the first storage chamber. The cartridge attachment portion includes a connecting portion, a second storage chamber, a second fluid communication portion. The connecting portion is detachably connectable to the supply portion. The second storage chamber is configured to store the ink supplied from the first storage chamber through the supply portion connected to the connecting portion by hydraulic head difference. The second air communication portion is configured to allow the second storage chamber to be in fluid communication with the atmosphere. The switch portion is configured to switch a state of the second air communication portion between a first state in which the second storage chamber is capable of being in fluid communication with the atmosphere and a second state in which an amount of air flow between the second storage chamber and the atmosphere is smaller than that in the first state. The recording portion has nozzles configured to eject the ink from the second storage chamber. The controller is configured to perform: controlling the switch portion to switch the state of the second air communication portion from the first state to the second state after a recordation command for instructing recording an image on a recording sheet is received; executing a recording process in which the recording portion is controlled so that the nozzles selectively eject ink on the recording sheet according to the recordation command; and after execution of the recording process, controlling the switch portion to switch the state of the second air communication portion from the second state to the first state.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1A:
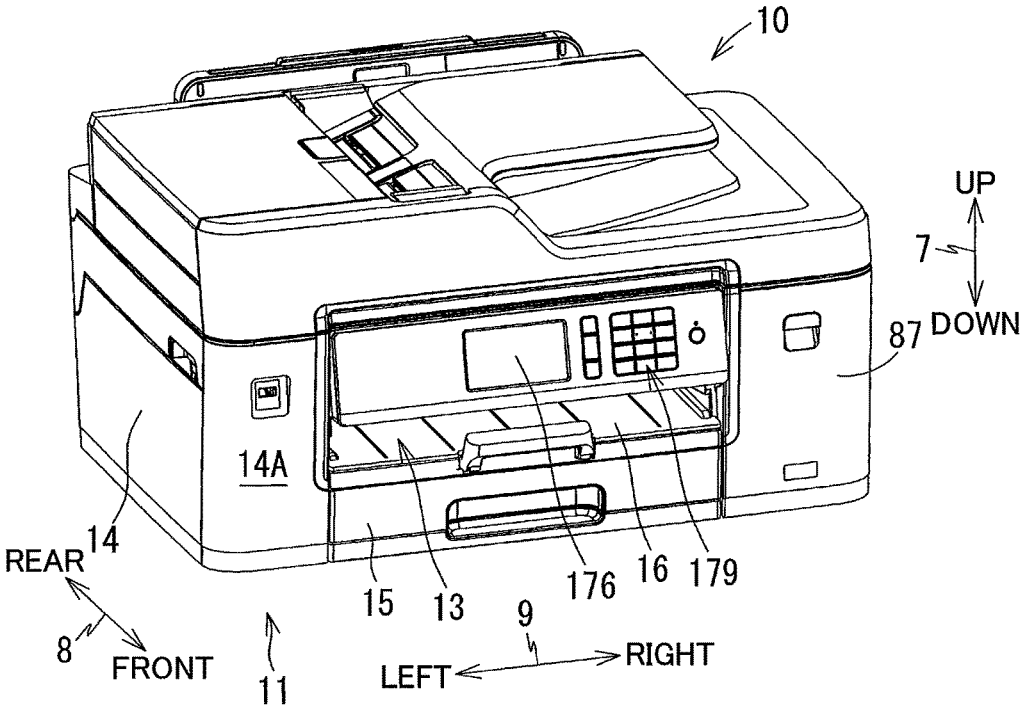
FIG. 1A is a perspective view of a multifunction peripheral as an example of an inkjet type image forming apparatus according to one embodiment, and illustrating a closed position of a cover.

Hereinafter, one embodiment of the disclosure will be described in detail while referring to the accompanying drawings wherein like parts and components are designated by the same reference numerals to avoid duplicating description. While the description will be made in detail with reference to specific embodiment, it would be apparent those skilled in the art that the embodiment described below is merely an example of the present disclosure and various changes and modifications may be made thereto without departing from the scope of the disclosure.

In the following description, an up-down direction 7 is defined with reference to the posture (posture illustrated in FIG. 1A, which is referred to as "usage posture") of a multifunction peripheral 10 according to the embodiment disposed on a horizontal plane in a usable state. A front-rear direction 8 is defined assuming a surface formed with an opening 13 as a front surface of the multifunction peripheral 10. A left-right direction 9 is a direction between the left and the right when a user views the multifunction peripheral 10 from its front side. In the present embodiment, the up-down direction 7 is parallel to the vertical direction and the front-rear direction 8 and the left-right direction 9 are parallel to horizontal directions in a state where the multifunction peripheral 10 is in the usage posture. Further, the front-rear direction 8 is perpendicular to the left-right direction 9.

[Overall Configuration of Multifunction Peripheral 10]

Figure 1B:
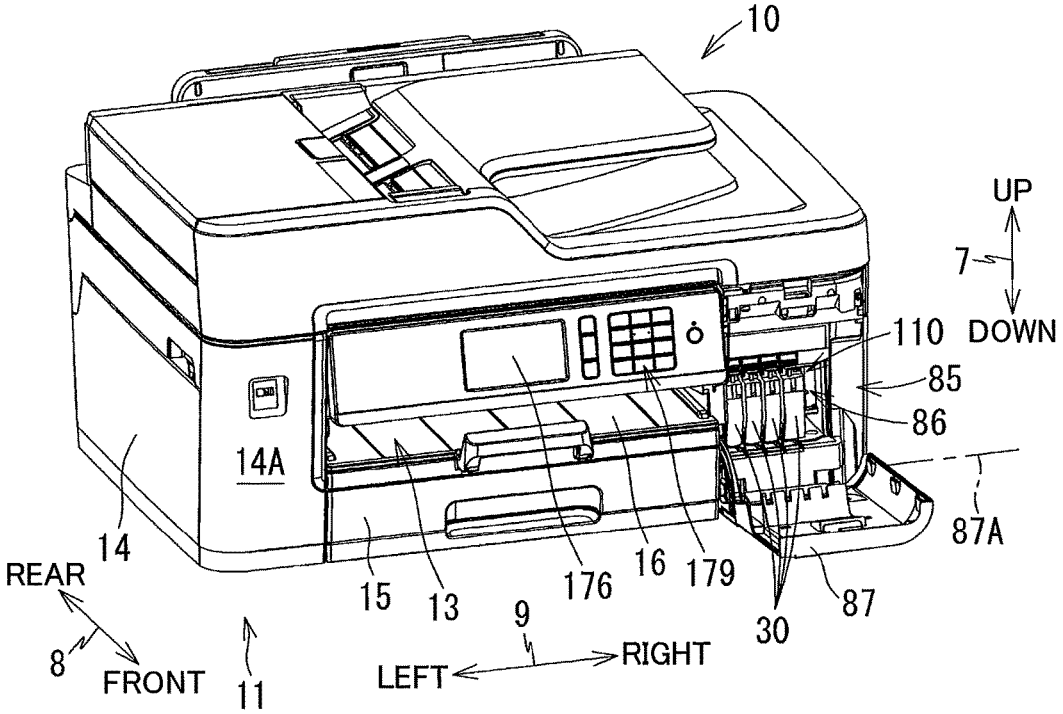
FIG. 1B is a perspective view of the multifunction peripheral as the example of the inkjet type image forming apparatus according to the embodiment, and illustrating an open position of the cover.

As illustrated in FIGS. 1A and 1B, the multifunction peripheral 10 (an example of an inkjet type image forming apparatus) has a substantially rectangular parallelepiped shape. The multifunction peripheral 10 has a printer portion 11 at its lower portion. The printer portion 11 has a casing 14 including a front surface 14A formed with an opening 13. The printer portion 11 is configured to form an image on a sheet 12 (see FIG. 2, an example of the recording sheet) by an inkjet recording system.

Figure 2:
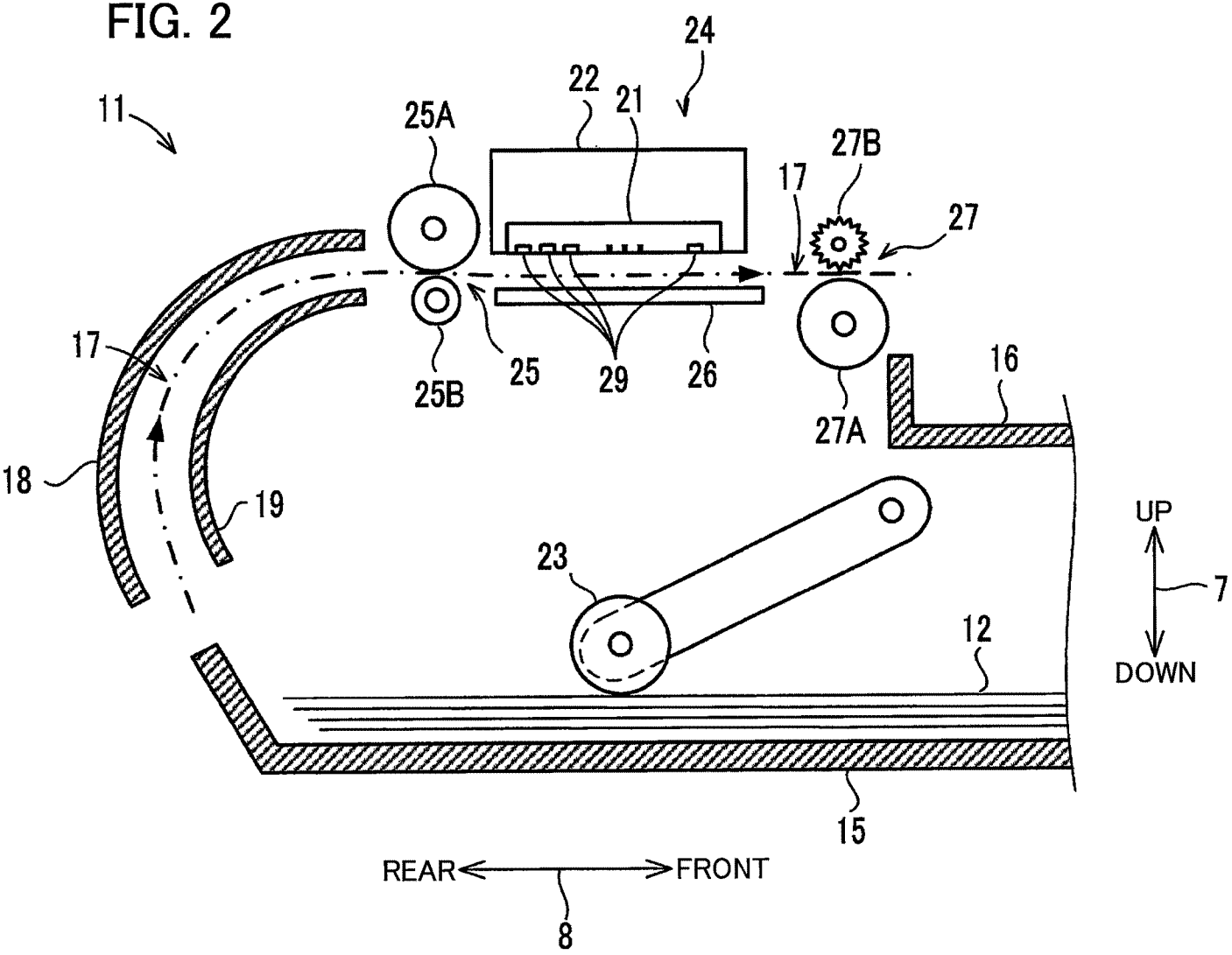
FIG. 2 is a vertical cross-sectional view schematically illustrating an internal configuration of a printer portion provided in the multifunction peripheral according to the embodiment.

As shown in FIGS. 1B and 2, the multifunction peripheral 10 also has a feeding roller 23, a feeding tray 15, a discharging tray 16, a pair of conveying rollers 25, a recording portion 24, a pair of discharging rollers 27, a platen 26, and a cartridge attachment portion 110. These components are arranged in the casing 14. The multifunction peripheral 10 has various functions such as a facsimile function and a print function. As described above, the state illustrated in FIG. 1A is the usage posture of the multifunction peripheral 10.

[Feeding Tray 15, Discharging Tray 16, and Feeding Roller 23]

As illustrated in FIGS. 1A and 1B, the feeding tray 15 can be inserted into and extracted from the casing 14 by a user in the front-rear direction 8 through the opening 13. The opening 13 is positioned at a center portion of the front surface 14A of the casing 14 in the left-right direction 9. As illustrated in FIG. 2, the feeding tray 15 can support a plurality of stacked sheets 12.

The discharging tray 16 is disposed above the feeding tray 15. The discharging tray 16 supports the sheet 12 discharged from between the recording portion 24 and the platen 26 by the discharging rollers 27.

The feeding roller 23 feeds the sheet 12 supported by the feeding tray 15 onto a conveyance path 17. The feeding roller 23 is driven by a feeding motor 172 (see FIG. 8).

[Conveyance Path 17]

As illustrated in FIG. 2, the conveyance path 17 is a space partially defined by an outer guide member 18 and an inner guide member 19 opposing each other at a predetermined interval inside the printer portion 11. The conveyance path 17 extends rearward and upward from the rear end portion of the feed tray 15, makes a U-turn to extend frontward and upward at a rear end side of the printer portion 11, passes through a space between the recording portion 24 and the platen 26, and reaches the discharging tray 16. The conveyance path 17 positioned between the conveying rollers 25 and the discharging rollers 27 in the front-rear direction 8 is provided substantially at a center portion of the multifunction peripheral 10 in the left-right direction 9, and extends in the front-rear direction 8. A conveying direction of the sheet 12 in the conveyance path 17 is indicated by a dashed-dotted arrow in FIG. 2.

[Conveying Rollers 25]

As illustrated in FIG. 2, the pair of conveying rollers 25 is disposed in the conveyance path 17. The conveying rollers 25 include a conveying roller 25A and a pinch roller 25B which are opposed to each other. The conveying roller 25A is driven by a conveying motor 171 (see FIG. 8). The pinch roller 25B is rotated following the rotation of the conveying roller 25A. The sheet 12 is nipped between the conveying roller 25A and the pinch roller 25B while the conveying roller 25A is rotated in a normal direction by the normal rotation of the conveying motor 171, thereby to be conveyed in the conveying direction (i.e., frontward).

[Discharging Rollers 27]

As illustrated in FIG. 2, the pair of discharging rollers 27 is disposed downstream of the conveying rollers 25 on the conveyance path 17 in the conveying direction. The discharge rollers 27 are examples of the conveyance path. The discharging rollers 27 include a discharging roller 27A and a spur 27B which are opposed to each other. The discharging roller 27A is driven by the conveying motor 171 (see FIG.

8). The spur 27B is rotated following the rotation of the discharging roller 27A. The sheet 12 is nipped between the discharging roller 27A and the spur 27B while the discharging roller 27A is rotated in a normal direction by the normal rotation of the conveying motor 171, thereby to be conveyed in the conveying direction (i.e., frontward).

[Recording Portion 24]

As illustrated in FIG. 2, the recording portion 24 is disposed between the conveying rollers 25 and the discharging rollers 27 on the conveyance path 17. The recording portion 24 is arranged to oppose the platen 26 in the up-down direction 7 such that the conveyance path 17 is interposed between the recording portion 24 and the platen 26. The recording portion 24 includes a carriage 22 and a recording head 21.

Figure 3:
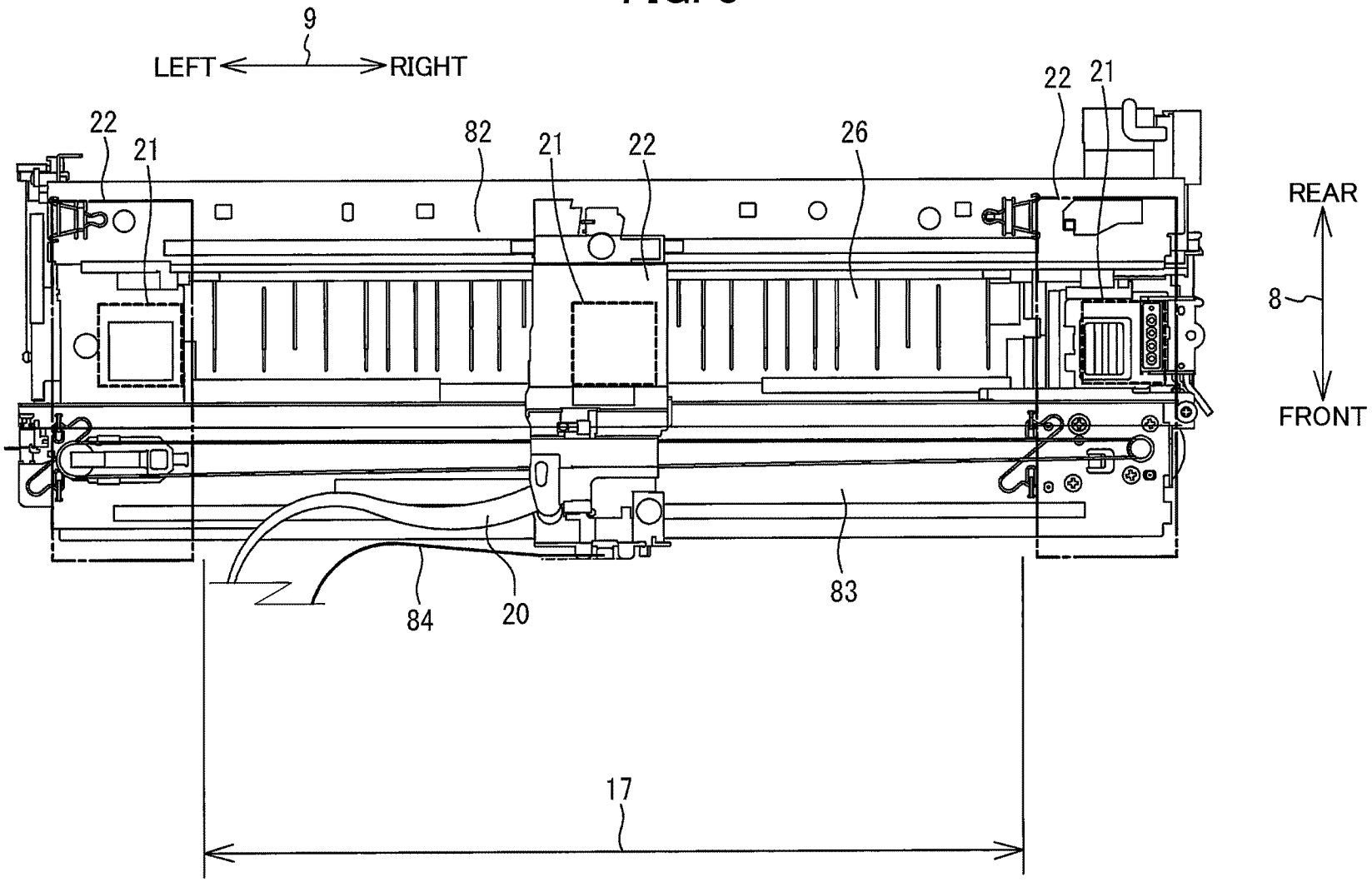
FIG. 3 is a plan view illustrating a positional relationship between a carriage and a platen provided in the multifunction peripheral according to the embodiment.

As illustrated in FIG. 3, the guide rails 82 and 83 are supported by the frame of the printer portion 11, and extend in the left-right direction 9 at positions spaced apart from each other in the front-rear direction 8, respectively. The carriage 22 is supported by the guide rails 82 and 83. A known belt mechanism is provided on the guide rail 83, and the carriage 22 is connected to the belt mechanism. The belt mechanism is driven by a carriage driving motor 173. The carriage 22 connected to the belt mechanism reciprocates in the left-right direction 9 by drive of the carriage driving motor 173 (see FIG. 8). The left-right direction 9 is an example of a main scanning direction. The movement region (range) of the carriage 22 extends from the right side of the right end of the conveyance path 17 to the left side of the left end of the conveyance path 17, as indicated by the alternate long and short dash line in FIG. 3.

An ink tube 20 and a flexible flat cable 84 extend from the carriage 22.

The ink tube 20 connects the cartridge attachment portion 110 (see FIG. 1B) and the recording head 21. The ink tube 20 supplies the recording head 21 with ink stored in each of ink cartridges 30 (examples of a cartridge) attached to the cartridge attachment portion 110. Four ink tubes 20 through which ink of respective colors (black, magenta, cyan, and yellow) flow are provided corresponding to the four kinds of ink cartridges 30 respectively, and these ink tubes 20 are connected to the carriage 22 in a bundled state.

The flexible flat cable 84 is intended to electrically connect a control unit 130 (example of a controller or a processor, see FIG. 8) and the recording head 21. The flexible flat cable 84 transmits a control signal, which is outputted from the control unit 130, to the recording head 21.

As illustrated in FIG. 2, the carriage 22 carries the recording head 21. The recording head 21 includes a plurality of nozzles 29 and piezoelectric elements 45 each corresponding to respective ones of the nozzles 29 (see FIG. 8). The nozzles 29 are arranged on the lower surface of the recording head 21. Each of the piezoelectric elements 45 deforms a part of the ink flow passage formed in the recording head 21 to eject ink droplets from corresponding one of the nozzles 29. As will be described later, the piezoelectric elements 45 operate when power is supplied by the control unit 130.

The recording portion 24 is controlled by the control unit 130. When the carriage 22 moves in the left-right direction 9, the recording head 21 ejects ink droplets from the nozzles 29 toward the sheet 12 supported by the platen 26. As a result, an image is formed on the sheet 12. Further, the ink stored in each ink cartridge 30 is consumed.

[Platen 26]

As illustrated in FIGS. 2 and 3, the platen 26 is disposed between the pair of conveying rollers 25 and the pair of discharging rollers 27 on the conveyance path 17 in the front-rear direction 8. The platen 26 is disposed to oppose the recording portion 24 in the up-down direction 7 such that the conveyance path 17 is interposed between the platen 26 and the recording portion 24. The platen 26 supports, from below, the sheet 12 conveyed by the conveying rollers 25.

[Cover 87]

As illustrated in FIG. 1B, an opening 85 is formed in the front surface 14A of the casing 14 at the right end portion thereof. A storage space 86 capable of housing the cartridge attachment portion 110 is formed behind the opening 85. A cover 87 is attached to the casing 14 to cover the opening 85. The cover 87 is pivotable about a pivoting axis 87A (pivoting center) extending in the left-right direction 9 between a closed position (a position illustrated in FIG. 1A) for closing the opening 85 and an open position (a position illustrated in FIG. 1B) for opening the opening 85.

[Cartridge Attachment Portion 110]

Figure 4:
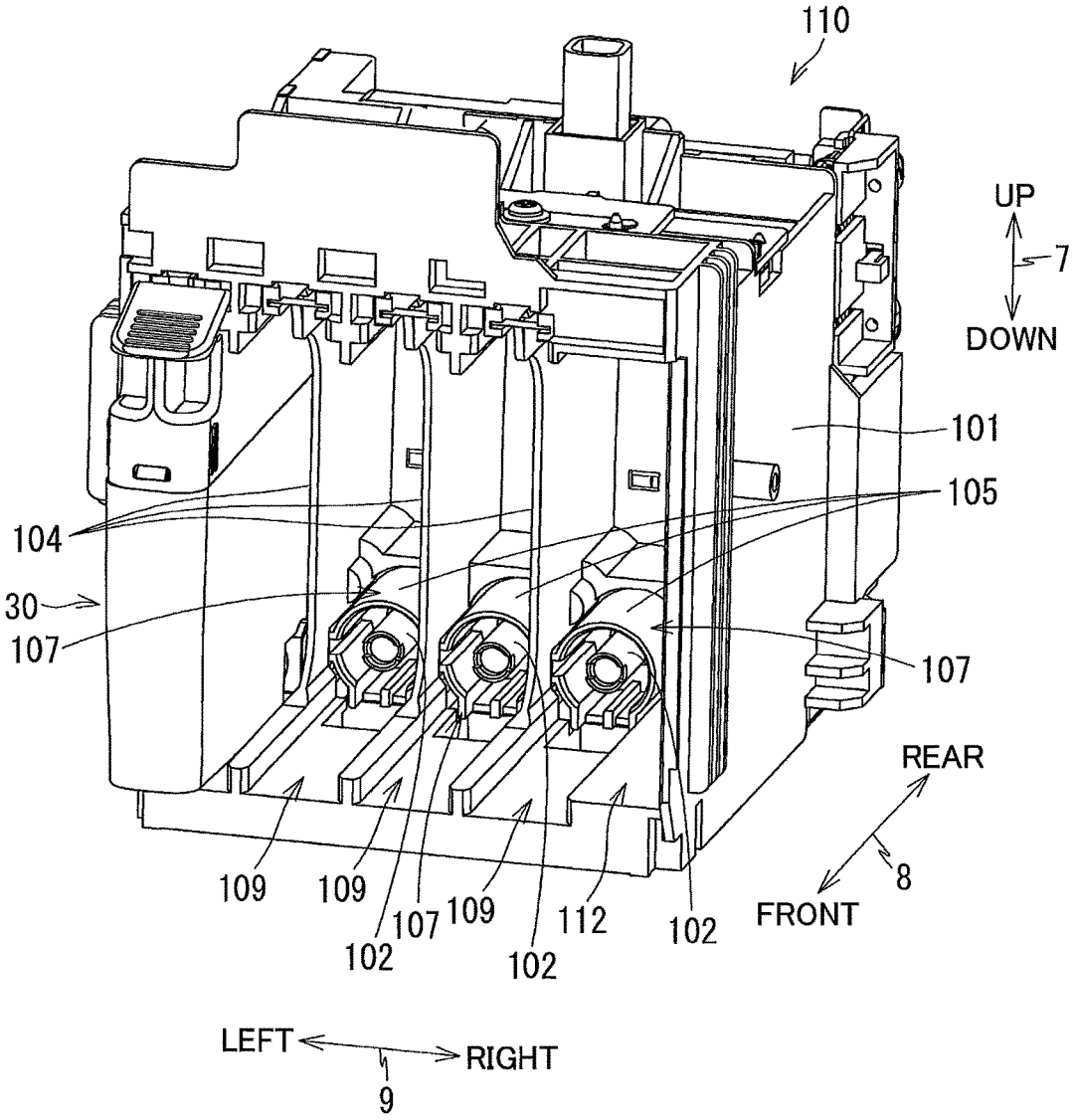
FIG. 4 is a perspective view of a cartridge attachment portion as viewed toward an opening of the cartridge attachment portion in the multifunction peripheral according to the embodiment.
Figure 5:
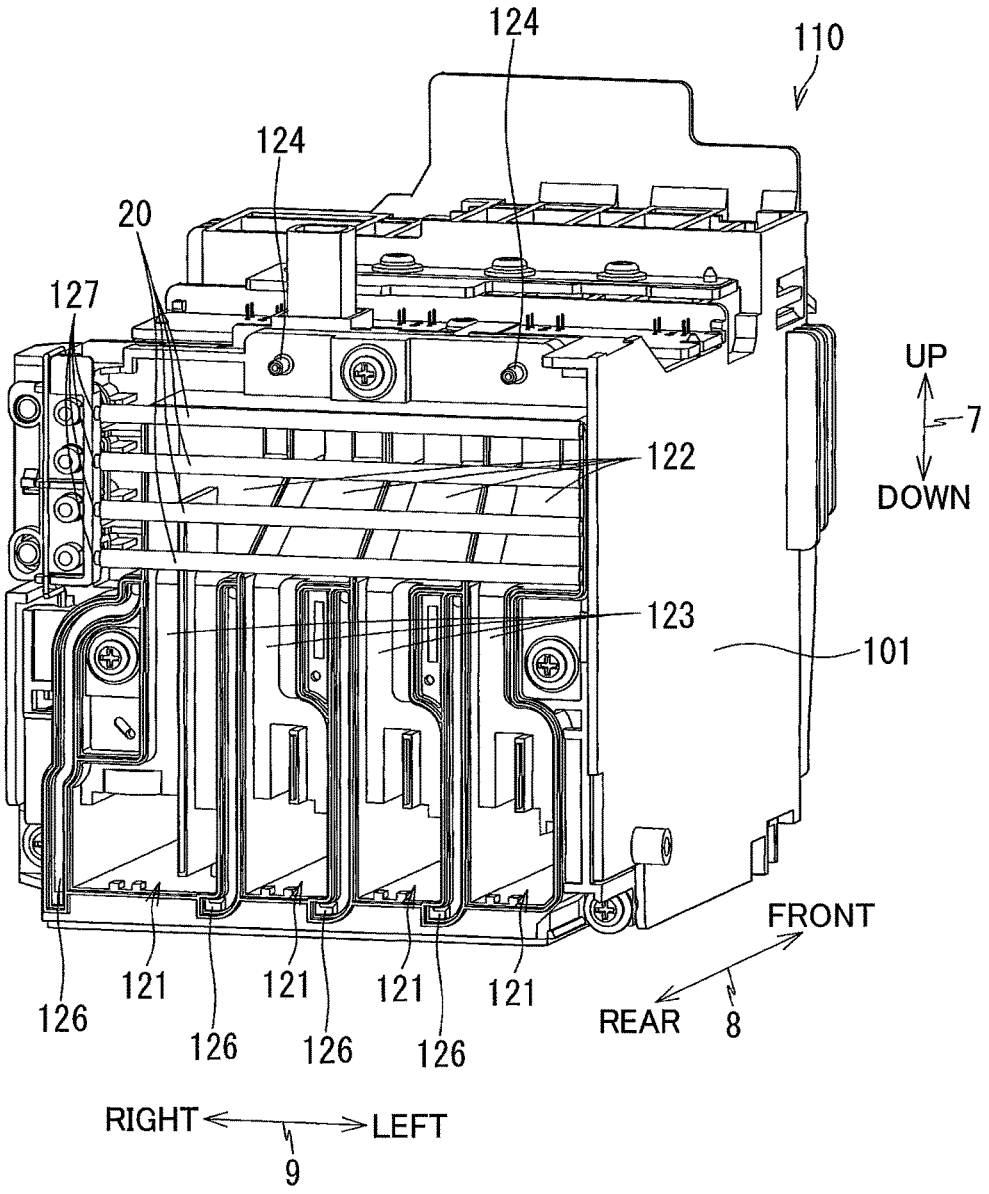
FIG. 5 is a perspective view of the cartridge attachment portion as viewed toward a tank of the cartridge attachment portion in the multifunction peripheral according to the embodiment.
Figure 6:
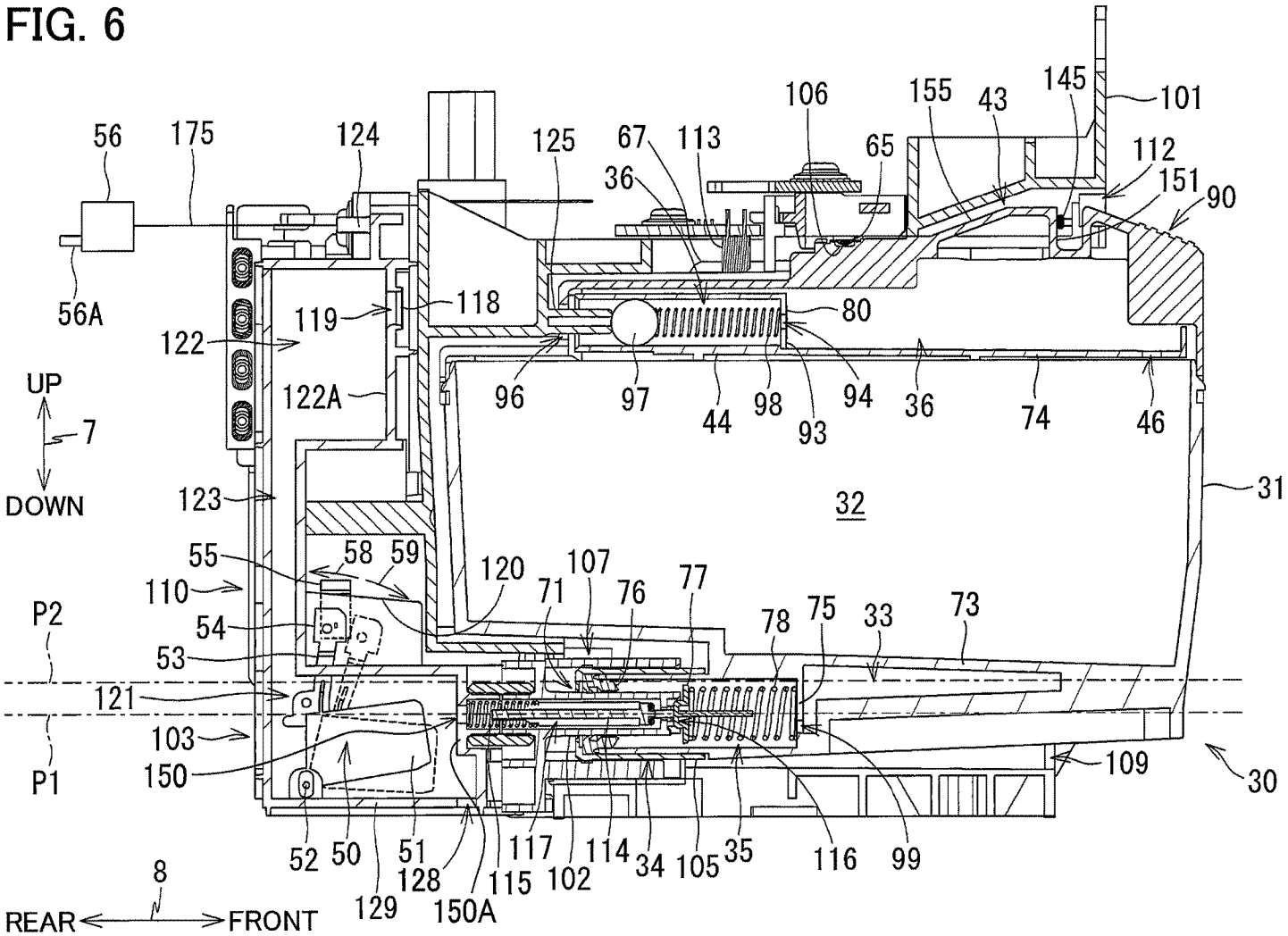
FIG. 6 is a vertical cross-sectional view of the cartridge attachment portion to which an ink cartridge is attached in the cartridge attachment portion according to the embodiment.

As illustrated in FIGS. 4 through 6, the cartridge attachment portion 110 includes a cartridge case 101, connecting portions 107, contacts 106, rods 125, attachment sensors 113, a locking shaft 145, tanks 103, and liquid level sensors 55 (examples of a sensor). In the cartridge attachment portion 110, four kinds of ink cartridges 30 corresponding to four colors of cyan, magenta, yellow, and black are detachably mountable. One connecting portion 107, one contact 106, one rod 125, one attachment sensor 113, one tank 103, and one liquid level sensor 55 are provided corresponding to each of the four kinds of ink cartridges. Note that the number of the ink cartridges 30 that can be mounted in the cartridge attachment portion 110 is not limited to four, but may be arbitrary.

[Cartridge Case 101]

As illustrated in FIGS. 4 and 5, the cartridge case 101 constitutes the casing of the cartridge attachment portion 110. The cartridge case 101 has a box-like shape defining an internal space therein. Specifically, the cartridge case 101 includes a top wall defining the top part of the internal space, a bottom wall defining the bottom part of the internal space, a rear wall connecting the top wall and the bottom wall, a left side wall defining the light end of the internal space, a right side wall defining the right end of the internal space, and an opening 112 positioned opposite to the rear wall in the front-rear direction 8. The opening 112 can be exposed to the front surface 14A of the casing 14 when using the multifunction peripheral 10. The user faces the front surface 14A when use the multifunction peripheral.

The ink cartridges 30 can be inserted into and extracted from the cartridge case 101 through the opening 85 of the casing 14 and the opening 112 of the cartridge attachment portion 110. In the cartridge case 101, the bottom wall of the internal space is formed with four guide grooves 109 for guiding insertion/extraction of the ink cartridges 30. The ink cartridge 30 is guided in the front-rear direction 8 indicated in FIG. 4 by inserting the lower end portion of the ink cartridge 30 into the guide groove 109. The cartridge case 101 is also provided with three plates 104 that partition the internal space into four spaces each elongated in the up-down direction 7. Each of the four kinds of ink cartridges 30 can be mounted in a corresponding one of the four spaces partitioned by the plate(s) 104.

[Connecting Portion 107]

As illustrated in FIG. 4, each connecting portion 107 includes an ink needle 102 and a guide portion 105.

The ink needle 102 is made of resin and has a generally tubular shape. The ink needle 102 is disposed on a lower end portion of the rear wall constituting the cartridge case 101. Specifically, the ink needle 102 is disposed at a position located on the rear wall of the cartridge case 101 and corresponds to an ink supply portion 34 (an example of supply portion, to be described later) of the ink cartridge 30 attached to the cartridge attachment portion 110. The ink needle 102 horizontally protrudes frontward from the rear wall of the cartridge case 101.

The guide portion 105 has a cylindrical shape, and is provided on the rear wall to surround the ink needle 102. The guide portion 105 protrudes frontward from the rear wall of the cartridge case 101. The guide portion 105 has a protruding end that is open forward (see FIG. 6). Specifically, the ink needle 102 is positioned at a diametrical center of the guide portion 105. The guide portion 105 is shaped to allow the ink supply portion 34 of the attached ink cartridge 30 to be received in the guide portion 105.

The connecting portion 107 is not connected to the ink supply portion 34 of the ink cartridge 30 in a state where the ink cartridge 30 is not attached to the cartridge attachment portion 110. During insertion of the ink cartridge 30 into the cartridge attachment portion 110, i.e., in the course of action for bringing the ink cartridge 30 into an attached position attached to the cartridge attachment portion 110 (a position illustrated in FIG. 6), the ink supply portion 34 of the ink cartridge 30 enters into the guide portion 105 in the insertion direction (i.e., rearward). As the ink cartridge 30 is further inserted rearward, the ink needle 102 enters into an ink supply port 71 formed in the ink supply portion 34. As a result, the connecting portion 107 is connected to the ink supply portion 34. Hence, the ink stored in a storage chamber 33 formed in the ink cartridge 30 is allowed to flow into the tank 103 through an ink valve chamber 35 defined in the ink supply portion 34 and an internal space 117 defined in the ink needle 102. Incidentally, the ink needle 102 may have a flat-shaped tip end or a pointed tip end.

As illustrated in FIG. 6, a valve 114 and a coil spring 115 are housed in the internal space 117 of the ink needle 102. The valve 114 is movable in the front-rear direction 8 to open and close an opening 116 formed in a protruding tip portion of the ink needle 102. That is, the valve 114 opens and closes the internal space 117 of the ink needle 102. The coil spring 115 urges the valve 114 frontward. Accordingly, the valve 114 closes the opening 116 in a state where no external force is applied (a state where the ink cartridge 30 is not attached to the cartridge attachment portion 110). Further, a front end portion of the valve 114 urged by the coil spring 115 protrudes frontward from the opening 116 in a state where no external force is applied. In the process of connecting the connecting portion 107 and the ink supply portion 34, the valve 114 opens the opening 116. The operation of opening the opening 116 by the valve 114 will be described later.

[Contacts 106]

As illustrated in FIG. 6, four contacts 106 are provided on the top wall of the cartridge case 101. Each contact 106 protrudes downward from the top surface toward the internal space of the cartridge case 101. Although not illustrated in detail in the drawings, the four contacts 106 are arranged to be spaced apart from one another in the left-right direction 9. Each of the four contacts 106 is arranged at a position corresponding to corresponding one of four electrodes 65 of the ink cartridge 30 as will be described later. Each contact 106 is made of a material having electrical conductivity and resiliency. The contacts 106 are therefore upwardly resiliently deformable. Four sets of the four contacts 106 are disposed corresponding to the four kinds of ink cartridges 30 that can be mounted in the cartridge case 101. Note that the number of contacts 106 and the number of electrodes 65 may be arbitrary.

Each contact 106 is electrically connected to the control unit 130 (see FIG. 8) via an electrical circuit. When the respective contacts 106 are engaged with the corresponding electrodes 65 to be electrically connected to the same, so that: a voltage Vc is applied to the corresponding electrode 65; the corresponding electrode 65 is grounded; and power is supplied to the corresponding electrode 65. Due to establishment of the electrical connection between the contacts 106 and the electrodes 65, the data stored in an IC of the ink cartridge 30 is made electrically accessible. Outputs from the electrical circuits are configured to be inputted into the control unit 130.

[Rod 125]

As illustrated in FIG. 6, a rod 125 is provided at a position above the ink needle 102 on the rear wall of the cartridge case 101. The rod 125 protrudes frontward from the rear wall of the cartridge case 101. The rod 125 has a cylindrical shape. The rod 125 is inserted into an air communication port 96 to be described later, in a state where the ink cartridge 30 is attached to the cartridge attachment portion 110, that is, when the ink cartridge 30 is in the attached position.

[Attachment Sensor 113]

As illustrated in FIG. 6, the attachment sensor 113 is also disposed at the top wall of the cartridge case 101. The attachment sensor 113 detects whether or not the ink cartridge 30 is attached to the cartridge attachment portion 110. The attachment sensor 113 is disposed at a position frontward of the rod 125 but rearward of the contacts 106. In the present embodiment, the attachment sensor 113 includes a light-emitting element and a light-receiving element. The light-emitting element is arranged to oppose the light-receiving element and is spaced apart from the light-receiving element in the left-right direction 9. When the ink cartridge 30 has been attached to the cartridge attachment portion 110, a light-shielding plate 67 (to be described later) of the attached ink cartridge 30 is disposed between the light-emitting element and the light-receiving element of the attachment sensor 113. In other words, the light-emitting element and the light-receiving element are arranged to oppose each other with the light-shielding plate 67 of the attached ink cartridge 30 interposed therebetween.

The attachment sensor 113 is configured to output different detection signals depending on whether or not light emitted in the left-right direction 9 from the light-emitting element is received by the light-receiving element. For example, the attachment sensor 113 outputs a low-level signal to the control unit 130 (see FIG. 8) when the light emitted from the light-emitting element is not received at the light-receiving element (that is, when an intensity of the light received at the light-receiving element is less than a predetermined intensity). On the other hand, the attachment sensor 130 outputs a high-level signal to the control unit 130 (see FIG. 8) when the light emitted from the light-emitting element is received at the light-receiving element (that is, when the intensity of the received light is equal to or greater than the predetermined intensity).

[Locking Shaft 145]

As illustrated in FIG. 6, the locking shaft 145 is disposed in the vicinity of the top wall of the cartridge case 101 and in the vicinity of the opening 112. The locking shaft 145 is a bar-like member extending in the left-right direction 9. The locking shaft 145 is, for example, a metal cylinder. The left end of the locking shaft 145 in the left-right direction 9 are fixed to the left side wall of the cartridge case 101, and the right end of the locking shaft 145 in the left-right direction 9 are fixed to the right wall of the cartridge case 101. The locking shaft 145 extends in the left-right direction 9 over four spaces in which the four kinds of ink cartridges 30 can be mounted.

The locking shaft 145 is adapted to hold the ink cartridge 30 attached to the cartridge attachment portion 110 at the attached position. The ink cartridge 30 is engaged with the locking shaft 145 in a state where the ink cartridge 30 is attached to the cartridge attachment portion 110. Accordingly, the locking shaft 145 holds the ink cartridge 30 against a force of pushing the ink cartridge 30 frontward by a coil spring 78 and a coil spring 98 of the ink cartridge 30.

[Tank 103]

As illustrated in FIGS. 4 through 6, a tank 103 is provided in a rear portion of the cartridge case 101. The tank 103 has a box shape having therein a storage chamber 121 (an example of a second storage chamber) and a buffer chamber 122. The storage chamber 121 and the buffer chamber 122 are arranged in the up-down direction 7. Specifically, the buffer chamber 122 is disposed at a position above the storage chamber 121. The storage chamber 121 and the buffer chamber 122 are in communication with each other by a flow passage 123 extending in the up-down direction 7. The storage chamber 121, the buffer chamber 122, and the flow passage 123 are spaces defined by the outer wall of the tank 103, respectively. The storage chamber 121 extends frontward from the flow passage 123. The storage chamber 121 is substantially rectangular in cross-section taken along a horizontal plane. The cross-sectional area of the storage chamber 121 taken along the horizontal plane is larger than the cross-sectional area of the flow passage 123 taken along the horizontal plane.

The storage chamber 121 is in communication with the internal space of the ink needle 102 at the front side via a communication port 150. The storage chamber 121 has a front wall 150A defining the front end of the storage chamber 121. The communication port 150 is formed in the front wall 150A. As a result, ink flowing out of the ink cartridge 30 through the ink needle 102 is stored in the storage chamber 121. In the tank 103, a convex portion 120 is formed at a position above the storage chamber 121 but frontward of the flow passage 123. An internal space of the convex portion 120 is connected to the storage chamber 121. The convex portion 120 has a pair of side walls facing in the left-right direction 9 and each of the side walls is made of a translucent member. An arm 53 and a detected part 54 of a pivoting member 50 described later are disposed in the convex portion 120.

As illustrated in FIG. 5, the storage chamber 121 is in communication with the ink flow passage 126 via a communication port 128 (FIG. 6). The storage chamber 121 has a bottom wall 129 (FIG. 6) defining the bottom end of the storage chamber 121. The communication port 128 is formed on the bottom wall 129 of the storage chamber 121. The communication port 128 is disposed below the communication port 150 and the connecting portion 107 in a direction of gravity (a lower direction).

The ink flow passage 126 extends upward from the storage chamber 121 and is connected to an ink outflow port 127. The ink tube 20 is connected to the ink outflow port 127. As a result, the ink stored in the storage chamber 121 flows out via the communication port 128 and is supplied to the recording head 21 through the ink flow passage 126 and the ink tube 20.

The buffer chamber 122 is in communication with an air communication port 124 formed in the upper part of the tank 103. Specifically, the buffer chamber 122 has a front wall 122A defining a front end of the buffer chamber 122. A through-hole 119 is formed on the front wall 122A (see FIG. 6). The buffer chamber 122 is in communication with the air communication port 124 through the through-hole 119. The through-hole 119 is sealed with a semipermeable membrane 118. The air communication port 124 is open to the outside through a switching portion 56 (described later). As a result, the storage chamber 121 and the buffer chamber 122 can be open to an atmosphere. That is, the air communication port 124 allows the storage chamber 121 and the buffer chamber 122 to be in communication with the atmosphere.

In FIG. 5, a film constituting the back surface of the tank 103 is omitted, but the back surfaces of each of the storage chamber 121, the buffer chamber 122, the flow passage 123, and the ink flow passage 126 are configured to be sealed with films.

[Pivoting Member 50]

As illustrated in FIG. 6, the pivoting member 50 is disposed in the storage chamber 121 of the tank 103. The pivoting member 50 is supported so as to be pivotably rotatable in directions of an arrow 58 and an arrow 59 by a supporting member (not illustrated) disposed in the storage chamber 121. The pivoting member 50 may be supported by a member other than the supporting member. For example, the pivoting member 50 may be supported by a wall of the cartridge case 101 that partitions the storage chamber 121.

The pivoting member 50 includes a float 51, a shaft 52, the arm 53, and the detected part 54. The float 51 is positioned in a lower part of the pivoting member 50. The float 51 is made of a material having a specific gravity smaller than that of the ink stored in the storage chamber 121. The shaft 52 protrudes from the left surface and the right surface of the float 51 in the left-right direction 9. The shaft 52 is inserted into a hole formed in the support member. As a result, the pivoting member 50 is supported by the supporting member so as to be pivotable about the shaft 52.

The arm 53 protrudes substantially upward from the float 51. The detected part 54 is formed at the protruding tip portion of the arm 53. The arm 53 and the detected part 54 are located in the internal space of the convex portion 120. The detected part 54 has a plate shape extending in the up-down direction 7 and the front-rear direction 8. The detected part 54 is made of a material that shields light outputted from a light-emitting element of the liquid level sensor 55 to be described later.

When the liquid level of the ink stored in the storage chamber 121 is higher than the position P1 of the connecting portion 107 in the up-down direction 7, in other words, when the level of the ink stored in the storage chamber 33 of the ink cartridge 30 is higher than the position P1 of the ink supply portion 34 in the up-down direction 7, the pivoting member 50 pivots in the direction of the arrow 58 due to buoyancy acting on the float 51. As a result, the pivoting member 50 is positioned at a detection position indicated by a solid line in FIG. 6.

In the present embodiment, the position P1 is the same height as the center of the axis of the ink needle 102 and is the same height as the center of the ink supply port 71. However, the position P1 is not limited to the position of the present embodiment as long as the position P1 is the same height as the connecting portion 107 and the ink supply portion 34 in the up-down direction 7. For example, the position P1 may be the same height as the upper end or the lower end of the ink needle 102, or may be the same height as the upper end or the lower end of the ink supply port 71.

On the other hand, when the ink stored in the storage chamber 121 and the ink valve chamber 35 is consumed and the liquid level of the ink stored in the storage chamber 121 is lowered to be a position equal to or lower than the position P1 in the up-down direction 7, the pivoting member 50 follows the liquid level of the ink stored in the storage chamber 121 and pivots in the direction of the arrow 59. As a result, the pivoting member 50 is positioned at a non-detection position indicated by the broken line in FIG. 6. That is, the pivoting member 50 changes its state under the condition that the liquid level of the ink stored in the storage chamber 121 arrives at the same position as the connecting portion 107 in the up-down direction 7.

[Liquid Level Sensor 55]

The liquid level sensor 55 (see FIG. 8) detects a state change of the pivoting member 50 provided with the detected part 54 so as to detect a position of the liquid level of the ink stored in the storage chamber 121. In the present embodiment, the liquid level sensor 55 includes a light-emitting element and a light-receiving element. The light-emitting element and the light-receiving element are arranged to be spaced apart from each other in the left-right direction 9 with the convex portion 120 of the tank 103 interposed therebetween. The light-emitting element is disposed on one of the right side and the left side of the convex portion 120, whereas the light-receiving element is disposed on the other of the right side and the left side of the convex portion 120. The optical path of the light outputted from the light-emitting element coincides with the left-right direction 9. When the pivoting member 50 is positioned at the detection position, the detected part 54 of the pivoting member 50 is positioned between the light-emitting element and the light-receiving element of the liquid level sensor 55.

The liquid level sensor 55 outputs detection signals different from each other dependent on whether or not the light outputted from the light-emitting element is received at the light-receiving element. For example, the liquid level sensor 55 outputs a low-level signal (indicating "a signal whose signal level is less than the threshold level") to the control unit 130 (see FIG. 8) under the condition that the light outputted from the light-emitting element cannot be received by the light-receiving element (that is, the intensity of the light received at the light-receiving element is less than the predetermined intensity). On the other hand, the liquid level sensor 55 outputs a high-level signal (indicating "a signal whose signal level is equal to or higher than the threshold level") to the control unit 130 under the condition that the light outputted from the light-emitting element can be received at the light-receiving element (that is the intensity of the light received at the light-receiving element is equal to or higher than the predetermined intensity).

The detected part 54 with the pivoting member 50 being at the detection position is positioned between the light-emitting element and the light-receiving element. Thus, when the liquid level of the ink stored in the storage chamber 121 of the tank 103 (in other words, the liquid level of the ink stored in the storage chamber 33 of the ink cartridge 30) is higher than the position P1 in the up-down direction 7, the light outputted from the light-emitting element cannot be received at the light-receiving element. Accordingly, the liquid level sensor 55 outputs the low-level signal to the control unit 130. On the other hand, the detected part 54 with the pivoting member 50 being at the non-detection position is retracted from between the light-emitting element and the light-receiving element. Thus, when the liquid level of the ink stored in the storage chamber 121 of the tank 103 (in other words, the liquid level of the ink stored in the storage chamber 33 of the ink cartridge 30) is equal to or lower than the position P1 in the up-down direction 7, the light outputted from the light-emitting element can be received at the light-receiving element. Accordingly, the liquid level sensor 55 outputs the high-level signal to the control unit 130.

In the present embodiment, in a case where the liquid level of the ink stored in the storage chamber 121 is equal to the position P1, the residual amount of the ink stored in the storage chamber 121 is a threshold residual amount. That is, the liquid level sensor 55 outputs a low-level signal to the control unit 130 when the residual amount of the ink stored in the storage chamber 121 is greater than the threshold residual amount. On the other hand, the liquid level sensor 55 output a high-level signal to the control unit 130 when the residual amount of the ink stored in the storage chamber 121 is smaller than or equal to the threshold residual amount. That is, the liquid level sensor 55 outputs signals different from each other depending on whether the residual amount of the ink stored in the storage chamber 121 is smaller than or equal to the threshold residual amount.

[Switch Portion 56]

Figure 8:
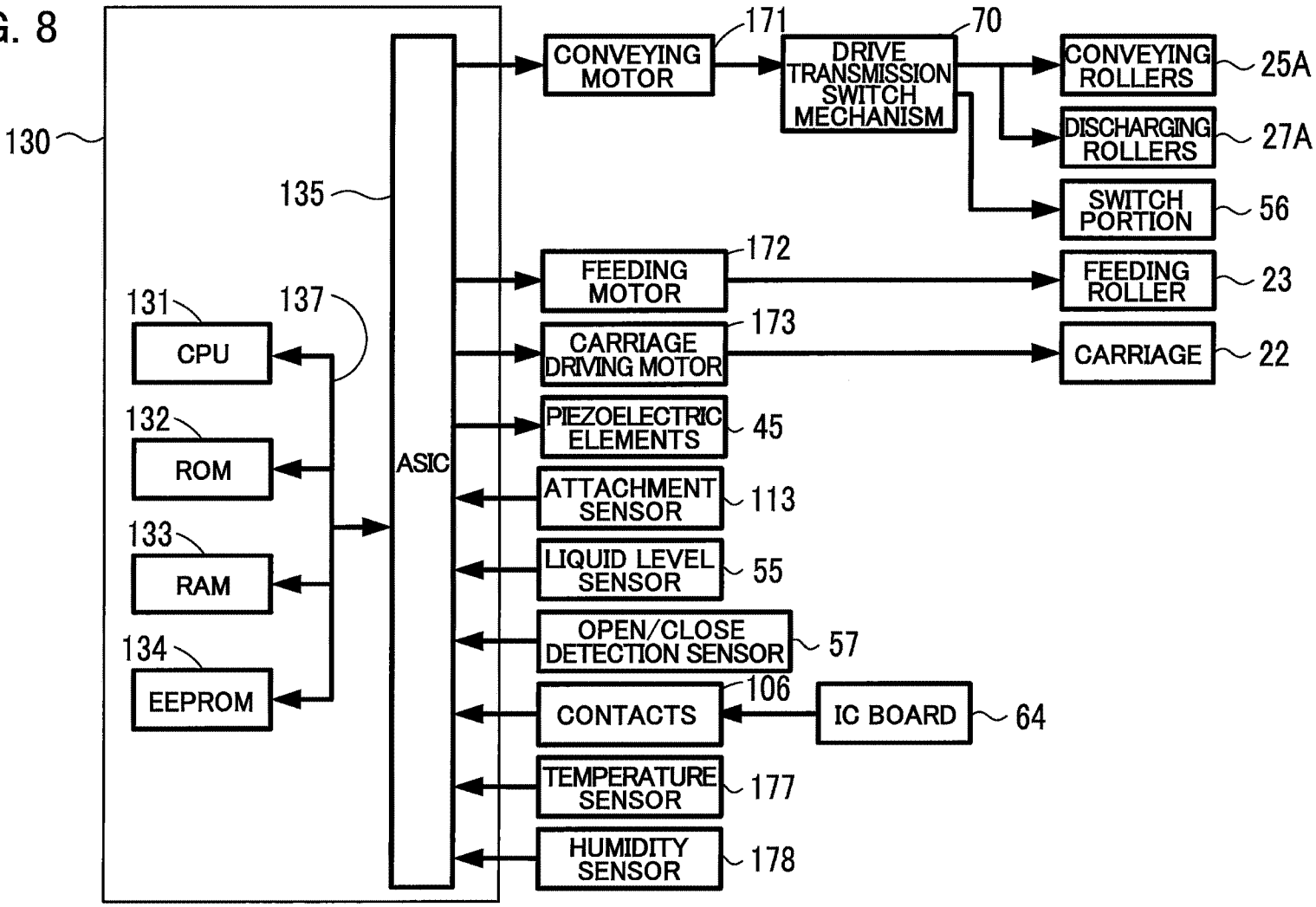
FIG. 8 is a block diagram illustrating a structure of a control portion in the multifunction peripheral according to the embodiment.

As described below in detail, two air communication ports 124 (first and second air communication ports 124) are provided in the cartridge attachment portion 110. The switch portion 56 shown in FIG. 8 is in air communication with insides of the two air communication ports 124 via a tube 175 (FIG. 6). That is, the tube 175 is divided in two branches from a main tube. An end of one branch of the tube 175 is connected to the first air communication port 124 and an end of another branch of the tube 175 is connected to the second air communication port 124. An end of the main tube of the tub 175 is connected to the switch portion 56. The air communication port 124 and the tube 175 are examples of the second air communication portion. The tube 175 is an example of the air flow passage.

The switch portion 56 switches a state of the air communication ports 124 from a first state to a second state. The first state is a state in which air communication from the air communication port 124 to outside of the cartridge attachment portion 110 (atmosphere) via the tube 175 is maintained (or established). The second state is a state in which the air communication from the air communication port 124 to outside of the cartridge attachment portion 110 (atmosphere) via the tube 175 is blocked.

For example, the switch portion 56 includes a cylinder and a rotation member having a columnar shape fitted inside the cylinder. The cylinder has a circular bottom wall, a circular top wall, and a side wall connecting the top wall and the bottom wall. An air port 56A (see FIG. 6) is formed in a side surface of the cylinder so as to establish air communication between inside of the cylinder and an atmosphere. A tube connection port is formed from the side wall of the cylinder at a position shifted from a position in the air port 56A in a circumferential direction of the rotational member. The tube connection port is connected to the tube 175. The tube connection port establishes air communication between the insides of the cylinder and the tube 175. A connection port is formed a side surface of the rotation member. In the embodiment, the connection port is a groove formed side surface of the rotation member and extend from the top of the rotation member to the bottom of the rotation member in the up-down direction 7. The groove has a length in the circumferential direction so that the air port 56A and the tube connection port can communicate with each other through a space between the groove and an inner surface of the cylinder of the switch portion 56. The rotation member rotates around an axis extending in the up-down direction 7 by receiving driving force transmitted from the conveying motor 171 (FIG. 8). In a case where a part of the connection port (the groove) opposes the air port 56A and another part of the connection port (the groove) opposes the tube connection port after rotation of the rotation member, the air communication port 124 shifts to the first state in which the air communication between the air communication port 124 and the atmosphere can be allowed via the tube 175, the connection port, and the air port 56A. In a case where the connection port (the groove) does not oppose the air port 56A or the tube connection port after rotation of the rotation member, the air communication between the connection port and the air port 56A is blocked, and thus the air communication port 124 shifts to the second state in which the air communication between the air communication port 124 and the atmosphere is blocked. The configuration to switch a state of the air communication between the communication maintained state (first state) and the communication blocked state (second state) is not limited to the configuration described above and any one of known various configurations may be employed.

In the present embodiment, two air communication ports 124 are provided in the cartridge attachment portion 110. Specifically, the first air communication port (the groove) 124 is provided in the tank 103 storing black ink (hereinafter, referred to as the first tank 103). The second air communication port 124 is provided in selected one of the three tanks 103 respectively storing inks of cyan, magenta, and yellow (hereinafter, referred to as the second tank 103) and is in air communication with remaining two tanks 103 other than the first and second tanks 103. The switch portion 56 is in air communication with each of the two air communication ports 124. When the rotation member is positioned so that the connection port and the air port 56A are opposed to each other, all the air communication ports 124 of the four tanks 103 are in the first state. On the other hand, the rotation member is positioned so that the connection port (the groove) and the air port 56A are not opposed to each other, all the air communication ports 124 of the four tanks 103 are in the second state. In the present embodiment, the air communication ports 124 of the four tanks 103 are in air communication with each other by the tube 175.

The relation between the switch portion 56 and the four tanks 103 is not limited to the above. For example, two switch portions 56 may be provided. In this case, the first switch portion 56 may be in air communication with the first tank 103 storing black ink therein, and the second switch portion 56 may be in air communication with remaining three tanks 103 storing ink of respective colors of cyan, magenta, and yellow. In this case, the first switch portion 56 switches a state of the air communication port 124 of the tank storing black ink, and the second switch portion 56 switches a state of the air communication ports 124 provided respectively in the tanks 103 storing ink of respective colors of cyan, magenta, and yellow. One switch portion 56 may be provided and connected to all of the air communication ports 124. Four air communication ports 124 may be provided for respective ones of the four tanks 103. Alternatively, four switch portions 56 may be provided for respective ones of the air communication ports 124. In this case, each switch portion 56 independently may switch a state of corresponding one of the air communication ports 124 of the four tanks 103.

[Drive Transmission Switch Mechanism 70]

Figure 9A:
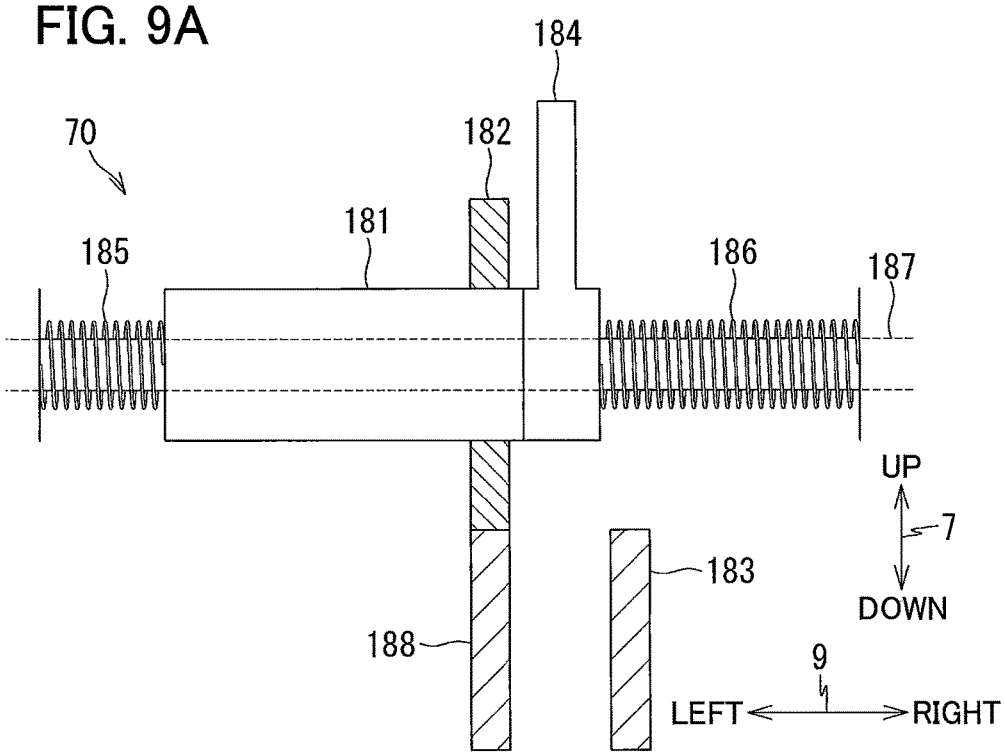
FIG. 9A is a schematic diagram illustrating a structure of a drive transmission switch mechanism in a non-drive state according to the embodiment.
Figure 9B:
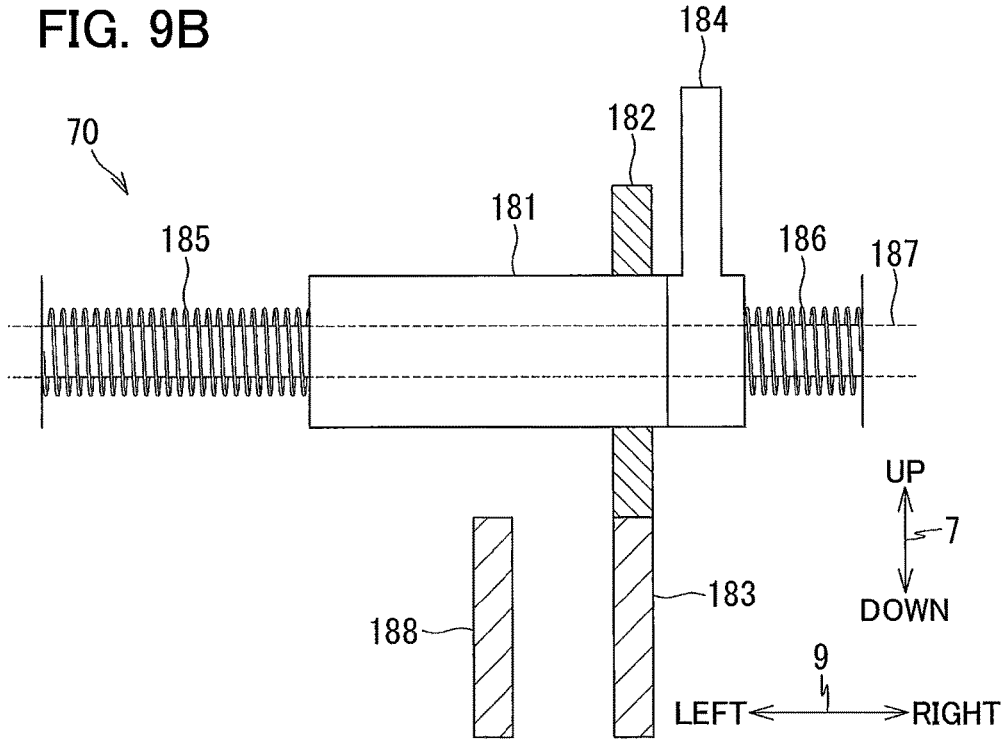
FIG. 9B is a schematic diagram illustrating the structure of the drive transmission switch mechanism in a drive state according to the embodiment.

As illustrated in FIGS. 8, 9A, and 9B, the printer portion 11 further includes a drive transmission switch mechanism 70. The drive transmission switch mechanism 70 is configured to switch between a first drive state and a second drive state. As shown in FIG. 9A, the second drive state is a state where drive force of the conveying motor 171 (an example of the drive source) can be transmitted to the conveying roller 25A and the discharging roller 27A while the drive force is not transmitted to the switch portion 56. As shown in FIG. 9B, the first transmission state is a state where drive force of the conveying motor 171 can be transmitted to the switch portion 56 while the drive force can be transmitted to neither the conveying roller 25A nor the discharging roller 27A. The drive transmission switch mechanism 70 is located at a position left side of the conveyance path 17 in the movement region of the carriage 22. In other words, the drive transmission switch mechanism 70 is located at a position shifted to right side from a region of the conveyance path 17 through which the sheet 12 passes. Alternatively, the drive transmission switch mechanism 70 may be located at a position shifted to left side from a region opposing the sheet 12 on the conveyance path 17.

The drive transmission switch mechanism 70 includes a slide portion 181, a drive gear 182, a first driven gear 183, a lever 184, springs 185 and 186, a supporting shaft 187, and a second driven gear 188.

The supporting shaft 187 extends in the left-right direction 9. The slide portion 181 has substantially a cylindrical shape slidably supported by the supporting shaft 187. Specifically, the slide portion 181 can slide in the left-right direction 9 along the supporting shaft 187. The drive gear 182 is rotatably supported by the slide portion 181. The slide portion 181 in conjunction with the drive gear 182 slides in the left-right direction 9.

The drive gear 182 is rotated by receiving drive force transmitted from the conveying motor 171. As shown in FIGS. 9A and 9B, the drive gear 182 can meshingly engage with the second driven gear 188 and the first driven gear 183. The second driven gear 188 meshes with a gear train which rotates the conveying roller 25A and the discharging roller 27A. The first driven gear 183 meshes with a gear train which rotates the rotation member of the switch portion 56. That is, as shown in FIG. 9A, the drive force of the conveying motor 171 rotates the conveying roller 25A and the discharging roller 27A by meshingly engagement between the drive gear 182 and the second driven gear 188. On the other hand, as shown in FIG. 9B, the drive force of the conveying motor 171 rotates the rotation member of the switch portion 56 by meshingly engagement between the drive gear 182 and the first driven gear 183.

When the drive force of the conveying motor 171 is transmitted to the switch portion 56 so as to rotate the rotation member of the switch portion 56, the state of the air communication ports 124 switches from the first state to the second state, or from the second state to the first state.

The lever 184 is supported by the supporting shaft 187 at a position right side of and neighboring the slide portion 181. The lever 184 is slidable along the supporting shaft 187 in the left-right direction 9. The lever 184 is movable between a first position shown in FIG. 9B and a second position shown in FIG. 9A. When the lever 184 is at the first position, the drive gear 182 intermeshes with the first driven gear 183. In this case, the drive transmission switch mechanism 70 is in the first drive state. When the lever 184 is at the second position, the drive gear 182 intermeshes with the second driven gear 188. In this case the drive transmission switch mechanism 70 is in the second drive state.

The lever 184 protrudes upward from a position of the slide portion 181. A tip end of the lever 184 reaches a position at which the lever 184 can contact to the carriage 22. That is, the lever 184 protrudes so as to reach the movement region of the carriage 22.

The springs 185 and 186 is supported by the supporting shaft 187. The spring 185 has a left end contacting with the frame of the printer portion 11 and a right end contacting with a left end surface of the slide portion 181. The spring 185 urges the slide portion 181 and the lever 184 contacting with the slide portion 181 toward right. The spring 186 has a right end contacting with the frame of the printer portion 11 and a left end contacting with a right end surface of the lever 184. The spring 186 urges the lever 184 and the slide portion 181 contacting with the lever 184 toward left. The urging force of the spring 186 is stronger than that of the spring 185.

When the carriage 22 is separate from the lever 184, the slide portion 181 and the lever 184 move to left by the urging force of the spring 186. Accordingly, the drive transmission switch mechanism 70 is in the second drive state shown in FIG. 9A. That is, the lever 184 is at the second position. In this state, the drive force of the conveying motor 171 is transmitted to the conveying roller 25A and the discharging roller 27A.

When the carriage 22 comes in contact with the lever 184 so as to push the lever 184 to right, the lever 184 moves right against the urging force of the spring 186. That is, the lever 184 is moves to the first position from the second position. In this state, the slide portion 181 follows the lever 184 so as to move right by the urging force of the spring 185. Accordingly, the drive transmission switch mechanism 70 shifts to the first drive state (FIG. 9B) from the second drive state (FIG. 9A). That is, the lever 184 shifts to the first position from the second position. In this state, the drive force of the conveying motor 171 is transmitted to the switch portion 56.

When the carriage 22 is separate from the lever 184 which is in the second position shown in FIG. 9B, the slide portion 181 and the lever 184 move to left by the urging force of the spring 186. Accordingly, the drive transmission switch mechanism 70 is in the second drive state shown in FIG. 9A from the first drive state shown in FIG. 9B. That is, the lever 184 moves to the second position from the first position. In this state, the drive force of the conveying motor 171 is transmitted to the conveying roller 25A and the discharging roller 27A.

As described above, the lever 184 moves to the first position or the second position depending on a state where the carriage 22 contacts to or separate from the lever 184.

[Open Close Detection Sensor 57]

As shown in FIG. 8, an open close detection sensor 57 is connected to the control unit 130. The open close detection sensor 57 detects a position of the rotation member of the switch portion 56. For example, when the rotation member of the switch portion 56 is at a position at which the connection port (the groove) of the rotation member opposes the air port 56A and the tube connection port, the open close detection sensor 57 outputs a low-level signal ("a signal whose signal level is less than the threshold level") to the control unit 130 (FIG. 8). When the rotation member of the switch portion 56 is at a position at which the connection portion of the rotation member is not opposed to the air port 56A (or the tube connection port), the open close detection sensor 57 outputs a high-level signal ("a signal whose signal level is greater than or equal to the threshold level") to the control unit 130.

That is, the open close detection sensor 57 outputs the low-level signal when the air communication port 124 is in the first state, and outputs the high-level signal when the air communication port 124 is in the second state. The open close detection sensor 57 may employ any one of conventional various sensors such as a proximity sensor and an optical sensor.

[Ink Cartridge 30]

Figure 7:
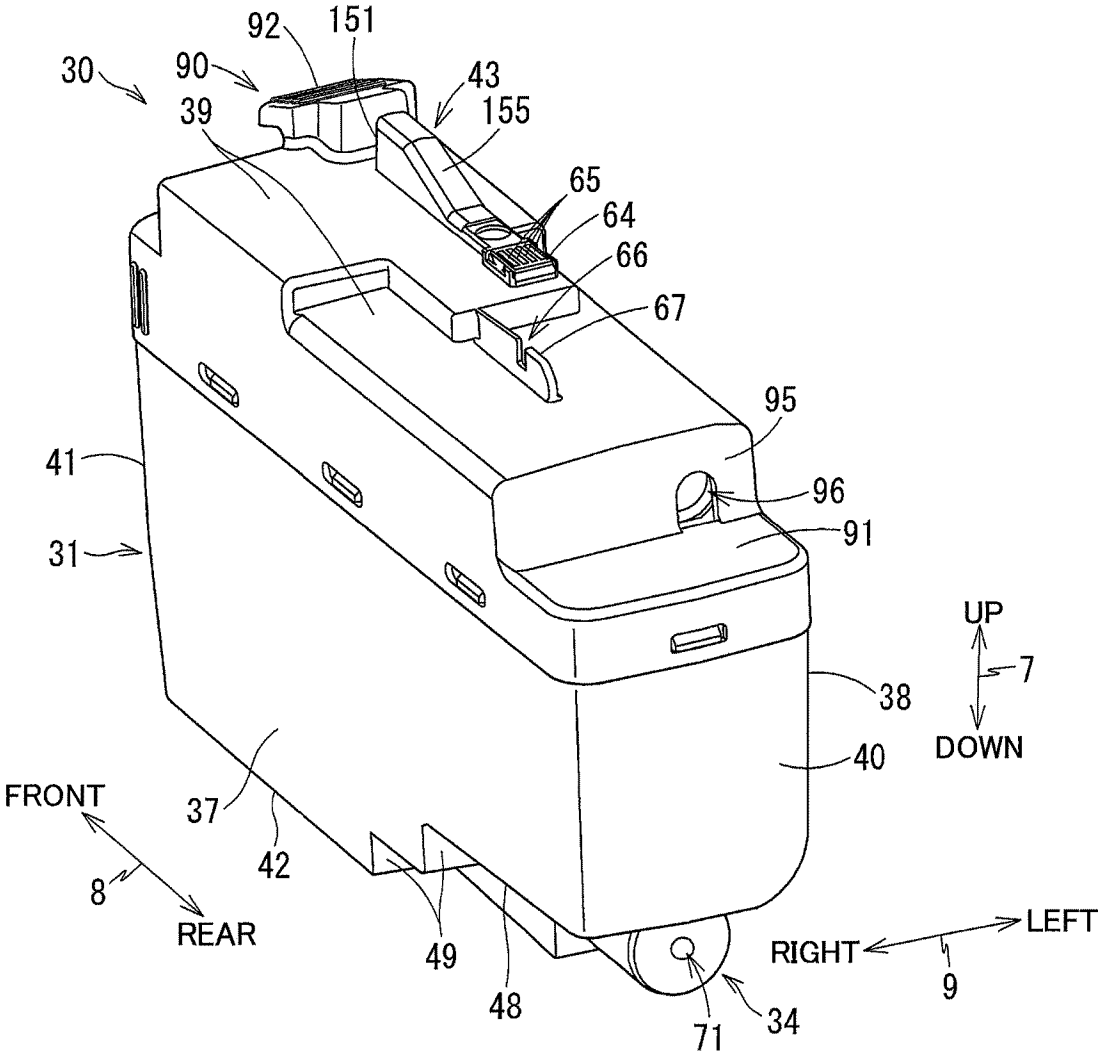
FIG. 7 is a perspective view of the ink cartridge as viewed from a rear side of the ink cartridge in the multifunction peripheral according to the embodiment.

The ink cartridge 30 illustrated in FIGS. 6 and 7 is a container configured to store ink therein. The posture of the ink cartridge 30 illustrated in FIGS. 6 and 7 is the usage posture.

As illustrated in FIGS. 6 and 7, the ink cartridge 30 has a substantially rectangular parallelepiped casing 31. The casing 31 includes a rear wall 40, a front wall 41, a top wall 39, a bottom wall 42, a right side wall 37, and a left side wall 38.

The casing 31 as a whole has a generally flat shape having a height in the up-down direction 7, a width in the left-right direction 9, and a length in the front-rear direction 8, the width being smaller than the height and the length. In the casing 31, at least the front wall 41 (an example of the outer surface of the cartridge) has translucency so that the liquid level of the ink stored in a storage chamber 32 (to be described later) and the storage chamber 33 can be visually recognized from the outside.

The casing 31 has a sub-bottom wall 48 positioned above the bottom wall 42. The sub-bottom wall 48 extends frontward continuously from the lower end of the rear wall 40. A rear end of the sub-bottom wall 48 is positioned rear side of a rear end of the ink supply portion 34. A front end of the sub-bottom wall 48 is positioned front side of the rear end of the ink supply portion 34. The bottom wall 42 and the sub-bottom wall 48 are continuous by a stepped surface 49. The ink supply portion 34 extends rearward from the stepped surface 49 below the sub-bottom wall 48 and above the bottom wall 42. The rear end of the sub-bottom wall 48 is not limited to the above, and may be at any position. For example, the rear end of the sub-bottom wall 48 may be positioned front side of the rear end of the ink supply portion 34.

A convex portion 43 is provided at the outer surface of the top wall 39 to protrude upward therefrom. The convex portion 43 extends in the front-rear direction 8. The convex portion 43 has a lock surface 151 facing frontward. The lock surface 151 is positioned above the top wall 39. The lock surface 151 is a surface that can come into contact with the locking shaft 145 from rear side thereof in a state where the ink cartridge 30 is attached to the cartridge attachment portion 110. After the lock surface 151 comes into contact with the locking shaft 145 from rear side thereof, the lock surface 151 pushes the locking shaft 145 frontward, so that the ink cartridge 30 is held in the cartridge attachment portion 110 against the urging force of the coil springs 78 and 98 (FIG. 8).

The convex portion 43 also has an inclined surface 155. The inclined surface 155 is disposed rearward of the lock surface 151. In the process of attaching the ink cartridge 30 to the cartridge attachment portion 110, the locking shaft 145 is guided along the inclined surface 155. As a result, the locking shaft 145 is guided to a position coming into contact with the lock surface 151.

An operation unit 90 is disposed in front of the lock surface 151 of the top wall 39. The operation unit 90 includes an operation surface 92. When the operation surface 92 is pushed down in a state where the ink cartridge 30 is attached to the cartridge attachment portion 110, the ink cartridge 30 pivots and the lock surface 151 therefore moves downward. Thus, the lock surface 151 is positioned lower than the locking shaft 145. As a result, the ink cartridge 30 can be extracted from the cartridge attachment portion 110 in an extraction direction (frontward).

The light-shielding plate 67 is provided at the outer surface of the top wall 39 to protrude upward therefrom. The light-shielding plate 67 extends in the front-rear direction 8. The light-shielding plate 67 is disposed rearward of the convex portion 43.

The light-shielding plate 67 is disposed between the light-emitting element and the light-receiving element of the attachment sensor 113 in a state where the ink cartridge 30 is attached to the cartridge attachment portion 110. As a result, the light-shielding plate 67 shields the light from the attachment sensor 113 traveling in the left-right direction 9. More specifically, when the light emitted from the light-emitting element of the attachment sensor 113 is incident on the light-shielding plate 67 before arriving at the light-receiving element, the intensity of the light received at the light-receiving element becomes less than the predetermined intensity, for example, zero. Note that the light-shielding plate 67 may completely shield the light traveling from the light-emitting element to the light-receiving element in the left-right direction 9, may partially attenuate the light, may refract the light to change a traveling direction thereof, or may fully reflect the light.

In the present embodiment, a notch 66 is formed in the light-shielding plate 67. The notch 66 is a space that is recessed downward from the upper end of the light-shielding plate 67, and spreads in the front-rear direction 8. Since the notch 66 is positioned in the attachment sensor 113, the light emitted from the light-emitting element of the attachment sensor 113 is not shielded before arriving at the light-receiving element. The type of the ink cartridge 30, that is, the type and the initial quantity of the ink stored in the ink cartridge 30 can be determined on the basis of the presence or absence of the notch 66 in the light-shielding plate 67. If the notch 66 is not formed in the light-shielding plate 67, the light-shielding plate 67 faces the light-emitting element of the attachment sensor in a state where the ink cartridge 30 is attached to the cartridge attachment portion 110.

An IC board 64 is provided between the light-shielding plate 67 and the convex portion 43 on the outer surface of the top wall 39 in the front-rear direction 8. The IC board 64 is electrically connected to the contact 106 (FIG. 6) in a state where the ink cartridge 30 is attached to the cartridge attachment portion 110.

An integrated circuit (IC; not illustrated in the drawings) and four electrodes 65 are mounted on the IC board 64. The IC board 64 is made of materials such as silicone. The four electrodes 65 are aligned in the left-right direction 9. The IC is a semiconductor integrated circuit that stores data indicating information related to the ink cartridge 30 such as a lot number, a date of manufacture, ink color, and the like in such a manner that the information is readable from the IC. The IC board 64 may be a flexible board on which the IC and the four electrodes 65 are mounted.

Each of four electrodes 65 is electrically connected to the IC, and extends in the front-rear direction 8. The four electrodes 65 are arranged to be spaced apart from one another in the left-right direction 9. Each electrode 65 is exposed so as to be electrically accessible to the upper surface of the IC board 64.

The casing 31 has a sub-top surface 91 at the rear end of the outer surface of the top wall 39. The outer surface of the top wall 39 and the sub-top surface 91 are continuous by a stepped surface 95. Specifically, the stepped surface 95 extends upward from the front end of the sub-top surface 91 disposed at the rear end of the outer surface of the top wall 39. The stepped surface 95 is a surface facing rearward. The stepped surface 95 is formed with an air communication port 96 (an example of a first air communication portion) through which the storage chamber 32 is in communication with the atmosphere. The air communication port 96 is positioned upward of a center of the casing in the up-down direction 7. The air communication port 96 is a through-hole that has a circular shape and formed in the stepped surface 95. An inner diameter of the air communication port 96 is larger than an outer diameter of the rod 125 (FIG. 6). In the process of attaching the ink cartridge 30 to the cartridge attachment portion 110, as illustrated in FIG. 6, the rod 125 enters an air valve chamber 36 (described later) through the air communication port 96. The rod 125 having entered the air valve chamber 36 moves a valve 97, which is for sealing the air communication port 96, frontward against the urging force of the coil spring 98. When the valve 97 is moved frontward and is separated from the air communication port 96, the storage chamber 32 is open to the atmosphere. A portion that seals the air communication port 96 is not limited to the valve 97. For example, a seal which is peelably attached to the stepped surface 95 may seal the air communication port 96.

As illustrated in FIG. 6, the storage chamber 32, the storage chamber 33, the ink valve chamber 35, and the air valve chamber 36 are formed inside the casing 31. The storage chamber 32, the storage chamber 33, and the ink valve chamber 35 store the ink. The air valve chamber 36 communicates air between the storage chamber 32 and the outside of the casing 31. The storage chamber 32 and the storage chamber 33 are disposed adjacent to each other in the up-down direction 7 with a partition wall 73 partitioning the inner space of the casing 31 interposed therebetween. Further, the storage chamber 32 and the storage chamber 33 communicate with each other through a through-hole (not illustrated) formed in the partition wall 73. The storage chamber 32 and the air valve chamber 36 are disposed adjacent to each other in the up-down direction 7 with a partition wall 74 partitioning the inner space of the casing 31 interposed therebetween. Further, the storage chamber 32 and the air valve chamber 36 communicate with each other through a through-hole 46 formed in the partition wall 74. The storage chamber 33 and the ink valve chamber 35 are disposed adjacent to each other in the front-rear direction 8 with a partition wall 75 partitioning the inner space of the casing 31 interposed therebetween. Further, the storage chamber 33 and the ink valve chamber 35 communicate with each other through a through-hole 99 formed in the lower end of the storage chamber 33. The storage chamber 32 and the storage chamber 33 are examples of a first storage chamber.

The valve 97 and the coil spring 98 are housed in the air valve chamber 36. The air valve chamber 36 communicates with the outside through the air communication port 96 formed in the stepped surface 95 (FIG. 7). The valve 97 is movable between a closed position at which the valve 97 seals the air communication port 96 and an open position at which the valve 97 is separated from the air communication port 96. The coil spring 98 is disposed to be extensible and contractible in the front-rear direction 8, and urges the valve 97 in a direction to move the valve 97 to contact the air communication port 96, that is, rearward. A spring constant of the coil spring 98 is smaller than a spring constant of the coil spring 78 of the ink supply portion 34.

As illustrated in FIG. 7, the ink supply portion 34 protrudes rearward from the stepped surface 49. The ink supply portion 34 has a cylindrical outer shape. The inner space of the ink supply portion 34 serves as the ink valve chamber 35. The ink supply portion 34 has a protruding end that is open rearward to the outside of the ink cartridge 30 through the ink supply port 71. As shown in FIG. 8, a seal member 76 is provided at the rear end of the ink supply portion 34. The front end of the ink supply portion 34 communicates with the lower end of the storage chamber 33 through the through-hole 99 as described above. That is, the ink supply portion 34 communicates with the lower end of the storage chamber 33.

The front end of the air valve chamber 36 is defined by a wall 93 formed with a through-hole 94. The storage chamber 32 communicates with the air valve chamber 36 through the through-hole 46 and the through-hole 94. The through-hole 94 is sealed with a semipermeable membrane 80.

A valve 77 and the coil spring 78 are housed in the ink valve chamber 35. The valve 77 moves in the front-rear direction 8 to open and close the ink supply port 71 penetrating the center portion of the seal member 76. The coil spring 78 urges the valve 77 rearward. Accordingly, the valve 77 closes the ink supply port 71 of the seal member 76 in a state where no external force is applied.

The seal member 76 is a disk-shaped member in which a through-hole is formed at the center portion thereof. The seal member 76 is made of, for example, an elastic material such as rubber or elastomer. The center portion of the seal member 76 is penetrated in the front-rear direction 8 to form a cylindrical inner peripheral surface serving as the ink supply port 71. The inner diameter of the ink supply port 71 is slightly smaller than the outer diameter of the ink needle 102.

When the ink cartridge 30 is attached to the cartridge attachment portion 110 in a state where the valve 77 closes the ink supply port 71 and the valve 114 closes the opening 116 of the ink needle 102, the ink needle 102 enters the ink valve chamber 35 through the ink supply port 71. That is, the connecting portion 107 and the ink supply portion 34 are connected to each other. At this time, the outer peripheral surface of the ink needle 102 liquid-tightly contacts the inner peripheral surface of the seal member 76 that defines the ink supply port 71, while elastically deforming the seal member 76. When the tip of the ink needle 102 passes through the seal member 76 to further enter the ink valve chamber 35, the tip of the ink needle 102 abuts on the valve 77. When the ink cartridge 30 is further inserted into the cartridge attachment portion 110, the ink needle 102 moves the valve 77 frontward against the urging force of the coil spring 78. As a result, the ink supply port 71 is opened.

Further, while the tip of the ink needle 102 abuts on the valve 77, the valve 77 abuts on the valve 114 from the front side and pushes it. Then, the valve 114 moves rearward against the urging force of the coil spring 115. Thus, the opening 116 is opened. As a result, the ink stored in the storage chambers 32 and 33 and the ink valve chamber 35 can flow into the storage chamber 121 of the tank 103 through the internal space 117 of the ink needle 102. Here, the storage chambers 32 and 33, the ink valve chamber 35, and the storage chamber 121 open to the atmosphere. Accordingly, the ink stored in the storage chamber 32, the storage chamber 33, and the ink valve chamber 35 is supplied to the storage chamber 121 of the tank 103 through the ink supply portion 34 by hydraulic head difference.

The storage chambers 121 and 122 are directly connected to the communication port 128 whereas the storage chambers 32 and 33 are connected via the ink needle 102 and the ink valve chamber 35. Here, the ink needle 102 accommodates the valve 114 and the coil spring 115 which increase passage resistance in the needle 102, and the ink valve chamber 35 accommodates the valve 77 and the coil spring 78 which increase passage resistance in the ink valve chamber 35. Accordingly, a resistance of passage from the storage chamber 32 or 33 to the recording portion 24 is larger than a resistance of passage from the storage chamber 121 or 122 to the recording portion 24.

[Control Unit 130]

Hereinafter, a schematic configuration of the control unit 130 will be described with reference to FIG. 8. The control unit 130 performs an image recording process according to a flowchart described later. The control unit 130 controls the overall operation of the multifunction peripheral 10. The control unit 130 includes a central processing unit (CPU) 131, a read-only memory (ROM) 132, a random access memory (RAM) 133, an electrically erasable programmable read-only memory (EEPROM) 134, an application specific integrated circuit (ASIC) 135, and an internal bus 137 which connects these components to one another.

The ROM 132 stores a program for causing the CPU 131 to control various operations including the image forming control. The RAM 133 is used as a storage region which temporarily stores data and signals used when the CPU 131 executes the program. The EEPROM 134 stores settings and flags to be retained even after the power of the multifunction peripheral 10 is turned off.

The conveying motor 171, the feeding motor 172, and the carriage driving motor 173 are connected to the ASIC 135. A drive circuit for controlling each motor is incorporated in the ASIC 135. When a drive signal for rotating a predetermined motor is inputted from the CPU 131 to a drive circuit corresponding to the predetermined motor, a drive current corresponding to the drive signal is outputted from the drive circuit to the corresponding motor. As a result, the corresponding motor rotates. That is, the control unit 130 controls the driving of the motors 171, 172, and 173.

Further, a signal outputted from the attachment sensor 113 is inputted to the ASIC 135. When the signal inputted from the attachment sensor 113 is at a low level, the control unit 130 determines that the ink cartridge 30 is attached to the cartridge attachment portion 110. On the other hand, when the signal inputted from the attachment sensor 113 is at a high level, the control unit 130 determines that the ink cartridge 30 is not attached to the cartridge attachment portion 110.

Furthermore, a signal outputted from the liquid level sensor 55 is inputted to the ASIC 135. When the signal inputted from the liquid level sensor 55 is at a low level, the control unit 130 determines that the liquid level of the ink stored in the storage chamber 121 of the tank 103 and the storage chamber 33 of the ink cartridge 30 is positioned above the position P1. On the other hand, when the signal inputted from the liquid level sensor 55 is at a high level, the control unit 130 determines that the liquid level of the ink stored in the storage chamber 121 of the tank 103 and the storage chamber 33 of the ink cartridge 30 is positioned at the position P1 or lower in the up-down direction 7. If the control unit 130 determines that the liquid level of the ink is positioned at the position P1 or lower in the up-down direction 7 according to change in the signal from the liquid level sensor 55 from the low level to the high level, the control unit 130 displays a warning that the cartridge needs to be replaced on the display, turns on the LED, or emits a buzzer sound from a speaker, thereby informing the user. The display, the LED, the speaker emitting the buzzer sound, are examples of the notifying portion. The processes for warning that the cartridge needs to be replaced, such as the display process are examples of the notifying process.

The control unit 130 determines the position in the up-down direction 7 of the liquid level of the ink stored in the storage chamber 33 with respect to each of the four kind of ink cartridges 30. Further, the control unit 130 determines the position in the up-down direction 7 of the liquid level of the ink stored in the storage chamber 121 with respect to each of the four tanks 103 corresponding to the four kinds of ink cartridges 30.

A temperature sensor 177 and a humidity sensor 178 are connected to the ASIC 135. A signal outputted from the temperature sensor 177 is inputted to the ASIC 135. The temperature sensor 177 outputs a signal depending on temperature. A signal outputted from the humidity sensor 178 is inputted to the ASIC 135. The humidity sensor 178 outputs a signal depending on humidity. A detection position of the temperature by the temperature sensor 177 and a detection position of the humidity by the humidity sensor 178 are not limited to special positions. However, these positions may be inside of the multifunction peripheral 10 or on a surface of the multifunction peripheral 10. The control unit 130 determines ambient temperature and ambient humidity based on signals inputted from the temperature sensor 177 and the humidity sensor 178, respectively.

The piezoelectric elements 45 are connected to the ASIC 135. Each of the piezoelectric elements 45 operates when power is supplied by the control unit 130 via a drive circuit (not illustrated). The control unit 130 controls power supply to the piezoelectric elements 45 and selectively ejects ink droplets from the plurality of nozzles 29.

The open close detection sensor 57 is connected to the ASIC 135. A signal outputted from the open close detection sensor 57 is inputted to the ASIC 135. When the signal inputted from the open close detection sensor 57 is a low level signal, the control unit 130 determines that the air connection port 124 is in the first state. On the other hand, when the signal inputted from the open close detection sensor 57 is a high level signal, the control unit 130 determines that the air connection port 124 is in the second state.

When forming an image on the sheet 12, the control unit 130 controls the conveying motor 171 to execute an intermittent conveying process (an example of the conveyance process) for alternately repeating conveyance of the sheet 12 by a prescribed lines worth of length for line feed (described later) and stop of the conveyance with the conveying rollers 25 and the discharging rollers 27.

The control unit 130 executes an ejection process (an example of the recordation process) while the sheet 12 is stopped in the intermittent conveying process. The ejection process is a process for controlling the power supply to the piezoelectric elements 45 to eject ink droplets from the nozzles 29 while moving the carriage 22 in the left-right direction 9. That is, in the ejection process, the control unit 130 controls the nozzles 29 to eject ink droplets during a single pass (hereinafter also referred to as one pass) that moves the carriage 22 from one end of the printing range to another end of the printing range. As a result, one pass worth of image is formed on the sheet 12.

The multifunction peripheral 10 can form an image on an entire recordable region of the sheet 12 by alternately performing the intermittent conveying process and the ejection process. Specifically, an image is formed on a prescribed recordation region on the sheet 12 in one ejection process. Subsequently, the sheet is conveyed by the prescribed lines worth of length in one intermittent conveying process. In a subsequent ejection process, an image is formed on a next recordation region which is upstream of and adjacent to the prescribed recordation region in the conveying direction. By repeating these processes, the image is formed on the entire recordable region of the sheet 12. That is, the entire recordable region includes all of a plurality or recordation regions arranged in the conveying direction. The prescribed lines worth of length for line feed is a length in a conveying direction from a position on the sheet 12 at which the current ejection process is end to a position which is on a next recordation region of the sheet 12 among the plurality of recordation regions and faces the recording portion 24 when the next ejection process starts.

When the ink cartridge 30 in which a prescribed maximum amount is stored is attached to the cartridge attachment portion 110 in a state where the storage chamber 121 is empty, ink is supplied to the storage chamber 121 from the ink cartridge 30 by hydraulic head difference, and a prescribed amount of ink is stored in the storage chamber 121. The prescribed amount (initial residual amount of ink) is determined depending on the prescribed maximum amount, the configurations of the storage chambers 32 and 33 and the configuration of the ink valve chamber 35 of the ink cartridge 30, the configuration of the storage chamber 121 of the cartridge attachment portion 110, and the positional relationships among the chambers 32, 33, 35, and 121 in a state where the ink cartridge 30 is attached to the cartridge attachment portion 110. The initial amount of ink is stored in the ROM 132 or the EEPROM 134.

When ink droplets are ejected from the nozzles 29 in the ejection process, the control unit 130 performs dot count for counting the number of dots of ink droplets for each size of ink droplet. The control unit 130 calculates a value by multiplying an amount of ink corresponding to each size by the number of dots of the size, and obtains an ejected amount of ink by summing the calculated value for each size. The control unit 130 subtracts the ejected amount of ink from the initial residual amount of ink to obtain a reduced value (residual amount of ink). The reduced value (residual amount of ink) is stored in the RAM 133. Accordingly, the residual amount of ink is updated according to consumption of ink.

[Image Recordation Process]

The image recordation process for recording an image on the sheet 12 will be explained while referring to FIG. 10.

In S10 the control unit 130 determines whether a recordation command is received. When the control unit 130 receives a recordation command for instructing image recordation on the sheet 12 (S10: YES), in S20 the control unit 130 performs a switching control process. Here, the recordation command is transmitted to the control unit 130 via an operation portion 179 in the multifunction peripheral 10, or an external apparatus connected to the multifunction peripheral 10. The switching control process is for switching a state of the air communication ports 124 from the first state to the second state. The switching control process is described later in detail.

In S30 the control unit 130 determines whether the state of the air communication ports 124 is the first state on the basis of the input signal from the open close detection sensor 57. That is, the control unit 130 determines whether an air communication from the air communication ports 124 to outside of the cartridge attachment portion 110 is established. In other words, in S30 the control unit 130 determines whether the state of the air communication ports 124 is switched in the switching control process of S20.

When the air communication ports 124 are in the second state (S30: NO), the process goes to S70.

When the air communication port 124 is in the first state (S30: YES), in S40 the control unit 130 calculates (estimates) an ejection amount of ink to be ejected according to the recordation command based on image data included in the recordation command for each of the colors of black, cyan, magenta, and yellow. Further, in S40 the control unit 130 calculates, for each of colors, an estimated residual amount of ink by subtracting the ejection amount of ink from the current residual amount of ink (the initial amount of ink or the residual amount of ink stored in the RAM 133). The control unit 130 stores each estimated residual amount in the RAM 133 at an address different from an address of a region storing the current residual amount of ink.

The ejection amount of ink is calculated as follows for example. That is, the control unit 130 determines at least one of types of ink, a size of ink droplet, and the number of ejections for each size of each of the types of ink by referring to the image data. Here, the determined type(s) of ink which the recording head 21 will eject ink to the sheet 12 is based on the image data. When the monochrome print is executed for example, the determined type of ink droplets is a black color ink (that is, one type is determined in this case). Or, when the color print is executed, the determined types of ink droplets includes at least one of four types of inks of cyan, magenta, yellow, and blacks depending on the image data. The size of ink droplet is determined by density of each pixel value in the image data. The size of ink increases as the density of the pixel increases. In this example, the control unit 130 calculates the estimated ejection amount of ink value obtained by multiplying an amount of each size by the number of ejections of the size for each of the determined types of ink.

In S50 the control unit 130 determines whether the estimated residual amount of ink is smaller than a threshold residual amount for each of the determined types of ink. Here, the threshold residual amount is equivalent to an amount of ink stored in the storage chamber 121 when the liquid level of ink stored in the storage chamber 121 is equal to the position P1 in the up-down direction 7.

When at least one of the estimated residual mounts of inks of the determined types of ink calculated in S40 is smaller than or equal to the threshold residual amount (S50: YES), in S60 the control unit 130 switches the state of the air communication ports 124 from the first state to the second state. Specifically, the control unit 130 drives the carriage driving motor 173 so that the carriage 22 moves rightward, contacts with the lever 184, and moves the lever 184 rightward. Accordingly, the lever 184 moves to the first position from the second position, and driving force of the conveying motor 171 can be transmitted to the switch portion 56. Subsequently, the control unit 130 drives the conveying motor 171 and switches the state of the air communication ports 124 to the second state. The process of S60 is an example of the first switching process. In S60, the control unit 130 may switch the state of the air communication ports 124 from the first state to the second state only when all of the estimated residual mounts of inks calculated in S40 is smaller than or equal to the threshold residual amount. Or, the control unit 130 may switch the state of the air communication ports 124 from the first state to the second state only when the estimated residual mounts of inks calculated in S40 is smaller than or equal to the threshold residual amount for the predetermined number of types of ink. Alternatively, the control unit 130 may switch the state of the air communication ports 124 from the first state to the second state only when the estimated residual mounts of inks calculated in S40 is smaller than or equal to the threshold residual amount for each of specific type(s) of ink (for example, black ink and yellow ink). The control unit 130 skips S60 when NO determination is made in S50.

In S70 the control unit 130 drives the feeding motor 172 so that the feeding roller 23 feeds the sheet 12 supported by the feeding tray 15 on the conveyance path 17.

Further, in S70 the control unit 130 drives the conveying motor 171 so that the pair of conveying rollers 2 conveys the sheet 12 fed by the feeding roller 23 in the conveying direction until the sheet 12 reaches a print start position at which the sheet 12 opposes the recording portion 24. That is, the sheet 12 is conveyed so that the recording portion 24 can start printing the leading edge of the sheet 12. Here, the print start position is a position at which a downstream end of the sheet 12 in the conveying direction opposes a most upstream nozzle 29 in the conveying direction among the plurality of nozzles 29 formed in the bottom surface of the recording head 21. That is, "the sheet 12 reaches the print start position" indicates that the downstream end of the sheet 12 in the conveying direction opposes the most upstream nozzle 29. After the state of the air communication ports 124 is switched, the pair of conveying rollers 25A is controlled as follows. That is, the control unit 130 drives the carriage driving motor 173 so that the carriage 22 moves leftward and separates from the lever 184. Accordingly, the lever 184 moves leftward from the first position to the second position, and thus the driving force of the conveying motor 171 can be transmitted to the conveying roller 25A. Subsequently, the control unit 130 drives the conveying motor 171 so as to rotate the conveying roller 25A.

In S80 the control unit 130 performs the ejection process. Specifically, the control unit 130 drives the carriage driving motor 173 so as to move the carriage 22 while controlling power supply to the piezoelectric elements 45 so that the plurality of nozzles 29 ejects ink droplets. In this case, the control unit 130 selectively controls the plurality of nozzles 29 to eject ink droplets. Accordingly, the ink droplets are ejected to the prescribed recordation region of the sheet 12, and the one pass worth of image is recorded on the sheet 12.

In S90 the control unit 130 determines whether the present ejection process S80 is for the final pass. In other words, the control unit 130 determines whether there remains a region of the fed sheet 12 on which an image can be recorded.

When the present ejection process S80 is not for the final pass (S90: NO), in S100 the control unit 130 performs the intermittent conveying process. Specifically, the control unit 130 drives the conveying motor 171 so that the pair of conveying rollers 25 and the pair of discharging rollers 27 convey the sheet 12 by the prescribed lines worth of length. Thereafter, the process S80 is performed. That is, until the ejection process S80 is for the final pass, the processes S80-S100 are repeated.

When the ejection process S80 is for the final pass (S90: YES), in S110 the control unit 130 drives the conveying motor 171 so that the pair of discharging rollers 27 discharges the sheet 12.

After the sheet 12 is discharged, in S120 the control unit 130 determines whether an unprinted next page exists. That is, the control unit 130 determines whether there is image data whose image is unprinted on a sheet 12 from among image data received included in the recordation command.

When the unprinted page exists (S120: YES), the processes from S70 are executed. That is, through S70-S110, a new sheet 12 is feed from the feeding tray 15 and the image is recorded on the new sheet.

When the unprinted page does not exist (S120: NO), in S130 the control unit 130 drives the conveying motor 171 so that the state of the air communication ports 124 shifts to the first state. Accordingly, the air communication from the air communication ports 124 to the outside of the cartridge attachment portion 110 is established. The switching operation of the state of the air communication ports 124 is executed similarly to S60. The process S130 is an example of the second switching process.

The switching control process of S20 in FIG. 10 will be explained while referring to FIG. 11.

In S210 the control unit 130 determines whether the state of the air communication ports 124 is the second state on the basis of the inputted signal from the open close detection sensor 57. That is, the control unit 130 determines whether the air communication from the air communication ports 124 to outside of the cartridge attachment portion 110 is blocked.

When the state of the air communication ports 124 is the second state (S210: YES), that is, when the air communication from the air communication ports 124 to outside of the cartridge attachment portion 110 is blocked, the control unit 130 ends the switching control process while the state of the air communication ports 124 is maintained to the second state.

On the other hand, the state of the air communication ports 124 is the first state (S210: NO), that is, when the air communication from the air communication ports 124 to outside of the cartridge attachment portion 110 is established, in S220 the control unit 130 selects one of colors of the determined types of ink (hereinafter, referred to as the determined colors) as a target color. In S220, the control unit 130 determines whether, for the target color, the present remaining amount of ink (the remaining amount of the ink after the last ejection process is performed) is smaller than a first residual amount V1. The present remaining amount of ink of the target color is either one of the initial remaining amount of ink stored in the ROM 132 or the EEPROM 134 and the residual amount of ink stored in the RAM 133. The first residual amount V1 is larger than the threshold residual amount and is an amount of ink equivalent to an amount of ink stored in the storage chamber 121 when the liquid level of ink stored in the storage chamber 121 is equal to a position P2 (see FIG. 6) higher than the position P1 of the connecting portion 107 in the up-down direction 7.

When the present remaining amount of ink is greater than or equal to the first residual amount V1 for the target color (S220: NO), the control unit 130 goes to S270.

On the other hand, when the present remaining amount of ink is less than the first residual amount V1 for the target color (S220: YES), in S230 the control unit 130 determines whether, for the target color, the present remaining amount of ink is smaller than a second residual amount V2. The second residual amount V2 is smaller than the first residual amount V1 and larger than the threshold residual amount. The processes S220 and S230 are examples of the first determination process.

When the present residual amount of ink is greater than or equal to the second residual amount V2 (S230: NO), in S240 the control unit 130 determines whether, for the target color, an estimated ejection amount of ink to be ejected in the subsequent step S80 is larger than or equal to a first amount of ink D1 (an example of threshold amount of ink). On the other hand, when the present residual amount of ink is less than the second residual amount V2 for the target color (S230: YES), in S250 the control unit 130 determines whether, for the target color, the estimated ejection amount of ink to be ejected in the subsequent step S80 is larger than or equal to a second amount of ink D2 (an example of threshold amount of ink). The processes S240 and S250 are examples of the second determination process.

The estimated ejection amount of ink is calculated in S240, S250 on the basis of the image data, similarly to the step S40.

In the embodiment, each of the first amount of ink D1 and the second amount of ink D2 is obtained by subtracting the threshold residual amount from the present residual amount of ink of the target color. Here, the estimated ejection amount of ink that is compared with the first amount of ink D1 in S240 is larger than the estimated ejection amount of ink that is compared with the second amount of ink D2 in S250. Accordingly, the first amount of ink D1 is larger than second amount of ink D2. Either one of the first amount of ink D1 and the second amount of ink D2 may be different from the value obtained by subtracting the threshold residual amount from the present residual amount of ink, provided that the first amount of ink D1 is larger than second amount of ink D2.

Further, at least one of the first amount of ink D1 and the second amount of ink D2 may be based on at least one of the ambient temperature of the multifunction peripheral 10 and the ambient humidity of the multifunction peripheral 10, and may be larger or smaller than the value obtained by subtracting the threshold residual amount from the present residual amount of ink. In this case, each of the first amount of ink D1 and the second amount of ink D2 is small, as the ambient temperature or ambient humidity of the multifunction peripheral 10 is low. The control unit 130 determines the ambient temperature of the multifunction peripheral 10 on the basis of the signal from the temperature sensor 177 and the ambient humidity of the multifunction peripheral 10 on the basis of the signal from humidity sensor 178.

For example, in a case where the ambient temperature of the multifunction peripheral 10 is lower than a predetermined threshold temperature, the first amount of ink D1 and the second amount of ink D2 are respectively smaller than the first amount of ink D1 and the second amount of ink D2 which are set in a case where the ambient temperature of the multifunction peripheral 10 is higher than or equal to the predetermined threshold temperature.

Further, in a case where the ambient humidity of the multifunction peripheral 10 is lower than a predetermined threshold humidity, the first amount of ink D1 and the second amount of ink D2 are respectively smaller than the first amount of ink D1 and the second amount of ink D2 which are set in a case where the ambient humidity of the multifunction peripheral 10 is higher than or equal to the predetermined threshold humidity.

When the estimated ejection amount of ink to be ejected is smaller than the first amount of ink D1 for the target color (S240: NO), the control unit 130 goes to S270.

When the estimated ejection amount of ink to be ejected is larger than or equal to the first amount of ink D1 for the target color (S240: YES), in S260 the control unit 130 switches the state of the air communication ports 124 from the first state to the second state. The control unit 130 switches the state of the air communication ports 124 similarly to S60.

When the estimated ejection amount of ink to be ejected is smaller than the second amount of ink D2 for the target color (S250: NO), the control unit 130 goes to S270.

When the estimated ejection amount of ink to be ejected is larger than or equal to the second amount of ink D2 (S250: YES), in S260 the control unit 130 switches the state of the air communication ports 124 from the first state to the second state. The control unit 130 switches the state of the air communication ports 124 similarly to S60. The process S260 is an example of the first switch process. After executing S260, the control unit 130 ends the switching control process.

When NO determination is made in one of S220, S240, S250, and S260, in S270 the control unit 130 determines whether all of the determined colors are selected as the target color. When at least one of the determined colors is unselected as the target color, the control unit 130 returns to S210*a* to select the unselected color as the target color. When all of the determined colors are selected as the target color, the control unit 130 ends the switching control process while the state of the air communication ports 124 is maintained to the first state. As described above, the control unit 130 switches the state of the air communication ports 124 from the first state to the second state when a specific condition is satisfied. Here, the specific condition includes a condition that NO determination is made in S210, a condition that YES determination is made in S220, and a condition YES determination is made in S240 or S250 which is depending on determination of S230. In the above example, when the specific condition is satisfied for at least one of the determined colors, the state of the air communication ports 124 is changed to the second state. However, the state of the air communication ports 124 may be switched to the second state only when the specific condition is satisfied for all of the determined colors. Alternatively, in the above example, all of the determined colors are target for the determination steps S220, S230, S240, S250, and S260. However, at least one of the determined colors may be target for the determination steps S220, S230, S240, S250, and S260.

All of the determined colors may not be selected as the target color, but only specific color(s) may be selected as the target color. For example, only black may be selected as the target color, or only black and yellow may be selected as the target color. Alternatively, the number of colors selected as the target color may be predetermined.

In the variation structure where the plurality of switch portions 56 are provided, in S260 the control unit 130 may switch the state of the air communication port(s) 124 which is connected to the tank 103 storing the ink of the target color from the first state to the second state by controlling the switch portion 56 connected to the tank 103 storing the ink of the target color. In this case, until all the determined colors are selected in S210*a*, the selection of the target color in S210*a* may be repeated after S260 is executed. Similarly, in S60 the control unit 130 may switch the state of the air communication port(s) 124, which is connected to the tank 103 storing ink for which YES determination is made in S50, from the first state to the second state.

Figure 10:
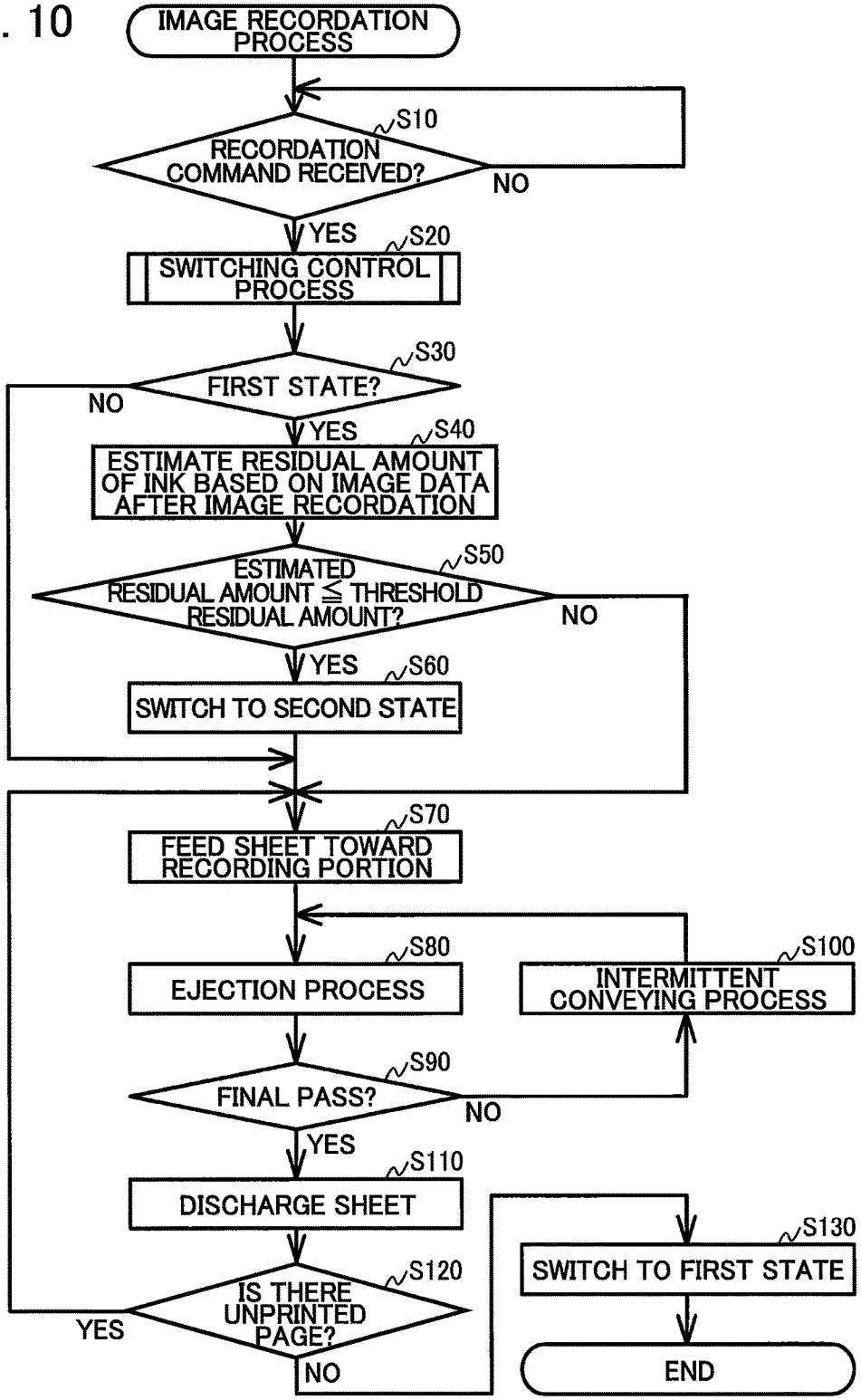
FIG. 10 is a flowchart illustrating an image recordation process according to the embodiment.
Figure 11:
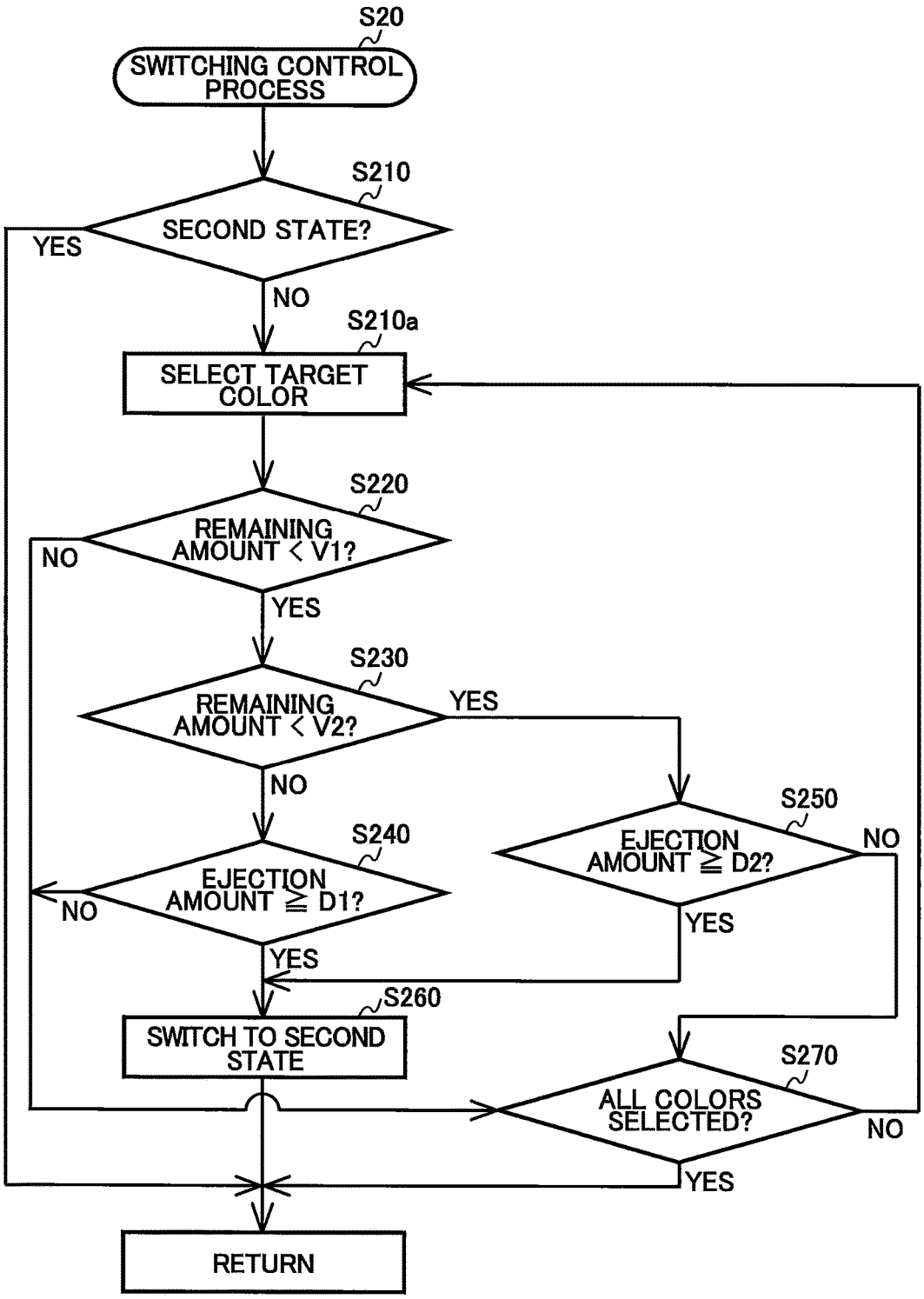
FIG. 11 is a flowchart illustrating a switching control process according to the embodiment.

In the flowchart shown in FIG. 10, the control unit 130 executes the steps S20-S50 in response to acquisition of the recordation command. The control unit 130 switches the state of the air communication ports 124 from the first state to the second state in a case where prescribed conditions are satisfied in the steps S20-S50. However, in response to acquisition of the recordation command, the control unit 130 may execute the step S60 without executing the steps S20-S50. That is, the control unit 130 may switch the state of the air communication ports 124 from the first state to the second state in response to acquisition of the recordation command without any additional condition being satisfied.

EFFECTS OF EMBODIMENT

According to the embodiment, in response to acquisition of the recordation command (S10), the state of the air communication ports 124 is switched to the second state from the first state (S60, S260). Accordingly, the amount of air flowing to the storage chamber 121 via the air communication ports 124 decreases, thereby reducing eccentric reduction in a level of ink stored in the storage chamber 121 more efficiently than when the state of the air communication ports 124 is maintained to the first state. On the other hand, in a conceivable case where the state of the air communication ports 124 is maintained to the second state, it is likely that rise in the temperature in the storage chamber 121 or vibration in the storage breaks meniscus of the nozzles 29. In the embodiment, the state of the air communication ports 124 is switched to the first state after the recordation process is finished (hereinafter, referred to as the stand-by state), thereby preventing the meniscus from being broken in the stand-by state.

It is likely that the amount of ink flowing into the recording portion 24 from the storage chamber 121 of the cartridge attachment portion 110 is larger than the amount of ink flowing into the recording portion 24 from the storage chambers 32 and 33 of the ink cartridge 30, thereby causing a difference between the level of ink stored in the 121 and the level of ink stored in the storage chambers 32 and 33. This problem becomes apparent in a case where the residual amount of ink stored in the storage chamber 121 is small. According to the embodiment, in a case where the residual amount of ink in the storage chamber 121 is smaller than the first residual amount V1 (S220: YES), that is, the residual amount of ink stored in the storage chamber 121 is small, the first switch process S260 is executed prior to the recordation process S80.

The above described problem concerning passage resistance becomes apparent in a case where the ink to be ejected in the recordation process (S80) is large. According to the embodiment, the estimated amount of ink is larger than the threshold amount of ink, the first switching process S260 is executed prior to the recordation process S80.

In the embodiment, the threshold amount of ink includes the first amount of ink D1 and the second amount of ink D2 smaller than first amount of ink D1. In a case where the residual amount of ink is greater than or equal to the second residual amount V2 in the first determination process (S230: NO) and where the estimated ejection amount of ink is larger than or equal to the first amount of ink D1 (S240: YES), the first switching process S260 is executed. On the other hand, in a case where the residual amount of ink is smaller than the second residual amount V2 in the first determination process (S230: YES) and where the estimated ejection amount of ink is larger than or equal to the second amount of ink D2 which is smaller than the first amount of ink D1 (S250: YES), the first switching process S260 is also executed. That is, as the amount of ink which is a subject for the first determination process is small, the residual amount of ink is easily determined smaller than the threshold residual amount in the second determination process. Accordingly, the determination of whether the first switching process is execute (S260) can be appropriately performed.

Viscosity of ink becomes high as the temperature falls or the humidity falls. The passage resistance becomes large as viscosity of ink becomes large. In the present embodiment, the first amount of ink D1 and the second amount of ink D2 are set to be smaller values as the ambient temperature of the multifunction peripheral 10 falls and as the ambient humidity of the multifunction peripheral 10 falls. Accordingly, the amount of ink can be easily determined to be smaller than the threshold residual amount in the second determination process (S240, S250), and the determination of whether the first switching process S260 is executed can be properly performed.

There is likely that throughput of the recordation process is reduced and so called FPOT (First Print Output Time) is lengthened in a structure where the switch portion 56 is switched by contact of the carriage 22 to the lever 184. In the present embodiment, the execution of the first switching process S260 is determined by the first determination process (S220, S230) and the second determination process (S240, S250), thereby improving throughput while resolving the problem concerning passage resistance described above.

According to the embodiment, the liquid level sensor 55 is provided for detecting the residual amount of ink stored in the storage chamber 121 and the recordation process executed with the air communication port 124 being in the second state. Accordingly, execution of a notification process for notifying shortage of ink can be prevented when the ink is remained in the storage chambers 32 and 33.

[Variation 1]

According to the above embodiment, the control unit 130 makes one determination of whether the state of the air communication ports 124 should be switched to the second state from the first state for one recordation command. However, the control unit 130 may make a plurality of determinations of whether the state of the air communication ports 124 should be switched to the second state from the first state for one recordation command. For example, the control unit 130 may make the determination for every pass.

Figure 12:
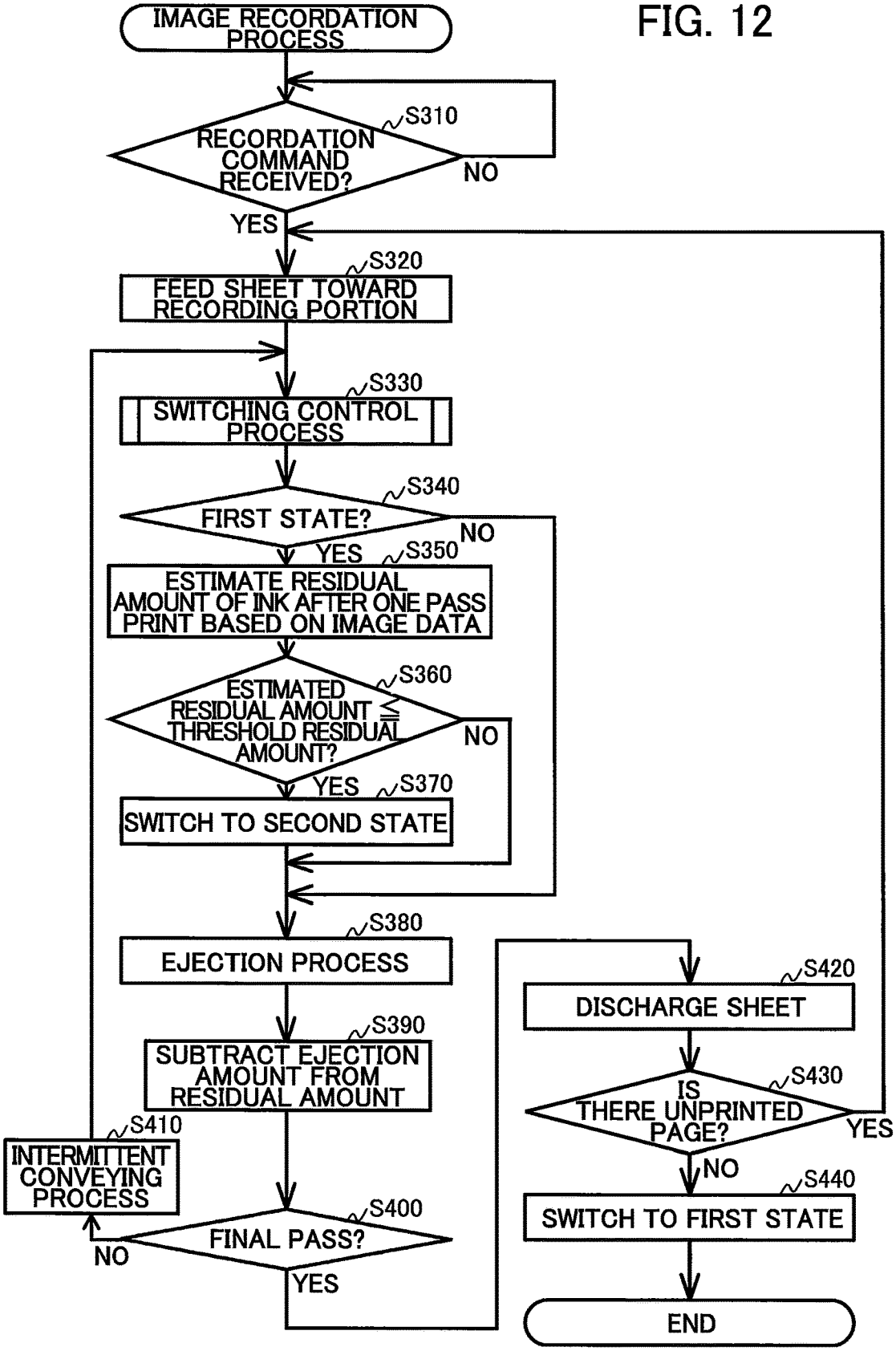
FIG. 12 is a flowchart illustrating an image recordation process according to a variation 1.

An image recordation process for recording an image on the sheet 12 according to a variation 1 will be explained while referring to FIG. 12.

When the control unit 130 receives a recordation command for instructing image recordation on the sheet 12 (S310: YES), in S320 the control unit 130 conveys the sheet 12 so that the recording portion 24 can start printing the leading edge of the sheet 12 similarly to S70. Here, the recordation command is transmitted to the control unit 130 via an operation portion 179 in the multifunction peripheral 10, or an external apparatus connected to the multifunction peripheral 10.

The control unit 130 performs processes S330-S370 respectively basically the same as the processes S20-S60 shown in FIG. 10. That is, the control unit 130 switches the state of the air communication ports 124 from the first state to the second state when the prescribed conditions are satisfied whereas maintains the first state when the prescribed conditions are not satisfied (S330-S370). However, the process for calculating an estimated residual amount of ink in S350 is different from that in S40 in the following points. In S350 the control unit 130 calculates, for each color, an ejection amount of ink to be used in a next pass (that is, an estimated ejection amount of ink to be ejected in a subsequent process S380) on the basis of the image data. Further, in S350 the control unit 130 calculates, for each color, an estimated residual amount of ink (an estimated residual amount of ink after the ink will be ejected in the next pass) by subtracting the calculated ejection amount of ink from a residual amount of ink (the initial residual amount or the amount of ink stored in the RAM 133).

In S380 the control unit 130 performs the ejection process and performs dot count for counting the number of dots of ink droplets for each size of ink droplet and obtains the ejected amount of ink for each color.

In firstly executed S390 the control unit 130 calculates a residual amount of ink by subtracting the ejected amount of ink ejected in S380 from the initial residual amount of ink stored in the ROM 132 or the EEPROM 134 for each color. The calculated residual amount of ink is stored in the RAM 133. In subsequently executed S390, the control unit 130 calculates the residual amount of ink by subtracting a ejected amount of ink ejected in the recently executed S380 from the residual amount of ink stored in the RAM 133 (that is the residual amount of ink stored in the previously performed S390) for each color.

In S400 the control unit 130 determines whether the pass executed in S380 is a final pass.

When the pass executed in S380 is not the final pass (S400: NO), in S410 the control unit 130 executes the intermittent conveying process. The steps S330-S410 are repeated until the pass executed in S380 is the final pass. Accordingly, through the processes S330-S370, the determination of whether the state of the air communication ports 124 should be the first state or the second state is executed for every pass.

When the pass executed in S380 is the final pass (S400: YES), in S420 the control unit 130 drives the conveying motor 171 so that the pair of discharging rollers 27 discharge the sheet 12.

After the sheet 12 is discharged, in S430 the control unit 130 determines whether there is a next page that is a target for print.

When there is the next page (S430: YES), the control unit 130 goes to S320. That is, a new sheet 12 is feed from the feeding tray 15 and an image is recorded on the sheet 12 through processes S320-S420.

When there is no next page (S430: NO), in S440 the control unit 130 drives the conveying motor 171 so that the air communication port 124 shifts to the first state. Specifically, the control unit 130 determines the present state of the air communication ports 124 on the basis of the signal inputted from the open close detection sensor 57. When the state of the air communication ports 124 is the second state, the control unit 130 controls the air communication port 124 to be in the first state. When the state of the air communication ports 124 is the first state, the control unit 130 maintains the first state of the air communication ports 124. By executing S440, the air communication between the air communication ports 124 and outside of the cartridge attachment portion 110 is established.

Because the estimated ejection amount is an amount for one pass worth of ink, the first amount of ink D1 and the second amount of ink D2 may be different values from those in the embodiment, provided that the first amount of ink D1 is larger than the second amount of ink D2.

As described above, the intermittent conveying process and the ejection process are repeated for each of the plurality of recordation regions, the first determination process (S220 and S230) and the second determination process (S240 and S250) are executed for each recordation region, and thus the first switching process (S260) can be executed at a proper timing.

[Other Variations]

In the variation 1, the determination (S330) of whether the state of the air communication ports 124 should be the first state or the second state is made for every pass. However, the determination (S330) may not executed for every pass.

Figure 13:
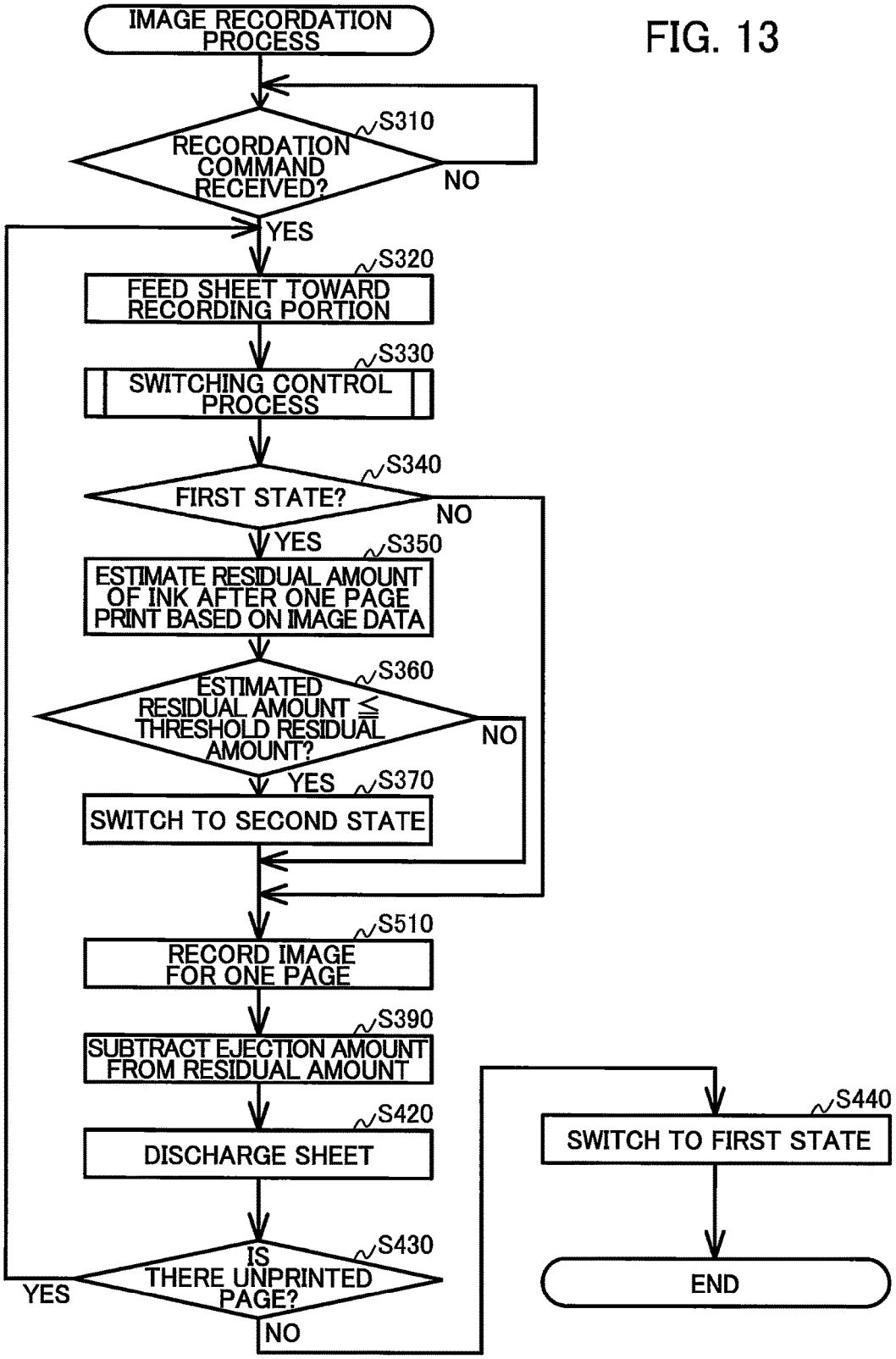
FIG. 13 is a flowchart illustrating an image recordation process according to another variation.

For example, according to an image recordation process as illustrated in a flowchart of FIG. 13, the determination (S330) of whether the state of the air communication ports 124 should be the first state or the second state is made each time an image for one page is recorded on a sheet 12. After performing S330-S370, in S510 an image for one page is recorded on a sheet 12 while repeating the intermittent conveying process and the ejection process. Subsequently, when there is a next page that is a target for printing (S430: YES), the processes S330-S370 are executed for the next page. In this variation, in S390 the control unit 130 calculates a residual amount of ink by subtracting the dot counted value (or the ejected amount) of the ink droplets ejected in S510 from the initial residual amount of ink or the residual amount of ink stored in the RAM 133 for each color. Further, in this variation, in S240 and S250, the ejection amount to be ejected in a next S510 (that is, an amount of ink to ejected in the image recordation process for the next page) is estimated and used.

In the image recordation process shown in FIG. 13, the process S350 for calculating the estimated residual amount of ink is different from the process S40. In S350, the control unit 130 calculates an ejection amount of ink to be ejected for one page to be printed (an ejection amount to be ejected in a next step S510 on the basis of the image data) for each color. That is, in S350 the control unit control unit 130 estimates a residual amount of ink (an estimated residual amount of ink after a next page will be printed) by subtracting the calculated ejection amount of ink from the initial residual amount of ink or the current residual amount of ink stored in the RAM 133.

In the variation 1 (and also the embodiment), the threshold amount of ink includes two amounts of ink (two values) (the first amount of ink D1 and the second amount of ink D2). However, in this variation, the threshold amount of ink may be one amount of ink (one value) or three or more amounts of ink (three or more values). Because the estimated ejection amount is an amount for one page worth of ink, the first amount of ink D1 and the second amount of ink D2 may be different values from those in the embodiment, provided that the first amount of ink D1 is larger than the second amount of ink D2.

In the embodiment, the switch portion 56 receives driving force from the conveying motor 171. However, the switch portion 56 may receive driving force from a motor different from the conveying motor 171 such as a dedicated drive motor for rotating the rotational member of the switch portion 56. In this case, the driving force can always be transmitted to the switch portion 56, and the switch portion 56 is driven when the dedicated drive motor starts drives. In this case, the printer portion 11 does not include the drive transmission switch mechanism 70.

Further, in the embodiment described above, the control unit 130 determines that the liquid level of the ink stored in the storage chamber 121 of the tank 103 and the storage chamber 33 of the ink cartridge 30 is positioned at the position P1 or lower in the up-down direction 7 under the condition that the input signal from the liquid level sensor 55 changes from the low-level signal to the high-level signal due to the state change of the pivoting member 50.

However, the control unit 130 may determine that the liquid level of the ink stored in the storage chamber 121 of the tank 103 and the storage chamber 33 of the ink cartridge 30 is positioned at the position P1 or lower in the up-down direction 7 under conditions other than the condition described above, provided that the determination depends on change in the input signal from the liquid level sensor 55.

For example, the control unit 130 may count the number of dots of ink droplets ejected from the recording head 21 after the input signal outputted from the liquid level sensor 55 changes from the low-level signal to the high-level signal due to the state change of the pivoting member 50. Further, the control unit 130 may determine that the liquid level of the ink stored in the storage chamber 121 of the tank 103 and the storage chamber 33 of the ink cartridge 30 is positioned at a predetermined position lower than the position P1 in the up-down direction 7 under condition that the dot count value (or the ejected amount of ink) is equal to or more than a prescribed value. Further, the prescribed value is determined on the basis of the internal volume of the storage chamber 121 below the connecting portion 107.

In the embodiment, the second state of the air communication ports 124 is a state where the air communication from the air communication ports 124 to the outside of the cartridge attachment portion 110 is blocked. However, the second state of the air communication ports 124 may be a state where the air communication from the air communication port 124 to the outside of the cartridge attachment portion 110 is not blocked. In this case, in the second state of the air communication ports 124, the amount of air flowing in the air communication port 124 per unit time is smaller than that in the first state.

For establishing the second state so that the amount of air flowing in the air communication port 124 per unit time in the second state is smaller than that in the first state, a plurality of ports having different sizes from each other is formed in an inner surface of the cylinder of the switch portion 56. The air can moves in the plurality of connection ports. The plurality of ports may have a first port and a second port smaller than the first port. In this case, the first state of the air communication ports 124 is a state when the rotation member of the switch portion 56 rotates so that the connection port and the air port 56A opposes the first port, and the second state of the air communication ports 124 is a state when the rotation member rotates so that the connection port and the air port 56A opposes the second port. In the embodiment, the connection port is the groove formed in the rotation member of the switch portion 56. The first port may be a groove formed in the rotation member and the second port may be another groove formed in the rotation member at a position shifted in a peripheral direction of the rotation member. In this case, a depth of the second port may be deeper than that of the second port so that amount of air flowing in the first port is larger than the in the second port. Alternatively, the plurality of ports may have a first port and a second port having a same size of the first port. In this case, only the second port is sealed by a semipermeable membrane.

In the above embodiment, the attachment sensor 113 and the liquid level sensor 55 are optical sensors each having a light-emitting element and a light-receiving element. However, the attachment sensor 113 and the liquid level sensor 55 may be sensors of a type different from the optical sensor, such as a proximity sensor.

In the above embodiment, the liquid level of the ink stored in the storage chamber 121 becoming lower than the position P1 was detected on the basis of pivoting of the pivoting member 50 disposed in the storage chamber 121 of each tank 103. However, the detection may be performed by methods other than pivoting of the pivoting member 50.

For example, a prism may be disposed at the same height as the position P1 in the storage chamber 121 of each tank 103. On the basis of facts that the traveling direction of the light incident on the prism is different depending on whether or not the liquid level of the ink stored in the storage chamber 121 is higher than the prism, it may be detected whether or not the liquid level of the ink stored in the storage chamber 121 is equal to or lower than the position P1.

Further, for example, two electrodes may be disposed in the storage chamber 121 of each tank 103. The lower end of one of the two electrodes may be at a position slightly higher than the position P1, whereas the lower end of the other of the two electrodes may be located below the position P1. Thus, it may be detected whether or not the liquid level of the ink stored in the storage chamber 121 is equal to or lower than the position P1 according to whether or not the current flows between the two electrodes through the ink.

In the embodiment, the through-hole 119 is sealed with the semipermeable membrane 118. However, the through-hole 119 may not be sealed with the semipermeable membrane 118. Further, the through-hole 94 is sealed with a semipermeable membrane 80. However, the through-hole 94 may not be sealed with a semipermeable membrane 80.

In the above-described embodiment, both of the connecting portion 107 of the cartridge attachment portion 110 and the ink supply portion 34 of the ink cartridge 30 extend in the horizontal direction. Further, the ink cartridge 30 is attached to the cartridge attachment portion 110 by being inserted into the cartridge attachment portion 110 in the horizontal direction. At this time, the connecting portion 107 and the ink supply portion 34 are connected to each other in the horizontal direction. However, the ink cartridge 30 may be attached to the cartridge attachment portion 110 by being inserted into the cartridge attachment portion 110 in a direction other than the horizontal direction, for example, in the up-down direction 7.

In this case, for example, the connecting portion 107 protrudes upward from the cartridge case 101. Further, the ink supply portion 34 protrudes downward from the bottom wall of the ink cartridge 30. Note that, in this case, the position P1 is set, for example, at the center position of the connecting portion 107 in the up-down direction 7 or the center position of the ink supply portion 34 in the up-down direction 7.

While the disclosure has been described in detail with reference to the above embodiments, it would be apparent to those skilled in the art that various changes and modifications may be made thereto.

What is claimed is:

1. An inkjet type image forming apparatus comprising:

a cartridge comprising:

a first storage chamber configured to store ink;

a first air communication portion allowing the first storage chamber to be in fluid communication with an atmosphere; and a supply portion configured to supply the ink stored in the first storage chamber;

a cartridge attachment portion comprising:

a connecting portion detachably connectable to the supply portion;

a second storage chamber configured to store the ink supplied from the first storage chamber through the supply portion connected to the connecting portion by hydraulic head difference; and a second air communication portion configured to allow the second storage chamber to be in fluid communication with the atmosphere;

a switch portion configured to switch a state of the second air communication portion between a first state in which the second storage chamber is capable of being fluid communication with the atmosphere and a second state in which an amount of air flow between the second storage chamber and the atmosphere is smaller than that in the first state;

a recording portion having nozzles configured to eject the ink from the second storage chamber, and a controller configured to perform:

controlling the switch portion to switch the state of the second air communication portion from the first state to the second state after a recordation command for instructing recording an image on a recording sheet is received;

executing a recording process in which the recording portion is controlled so that the nozzles selectively eject ink on the recording sheet according to the recordation command; and after execution of the recording process, controlling the switch portion to switch the state of the second air communication portion from the second state to the first state.

2. The inkjet type image forming apparatus according to claim 1, wherein the controller is further configured to perform:

specifying a residual amount of ink stored in the second storage chamber after the recordation command is received; and determining whether the residual amount of ink is smaller than a first residual amount, wherein when a specific condition is met, the recordation process is executed after controlling the switch portion to switch the state of the second air communication portion from the first state to the second state whereas when the specific condition is not met, the recordation process is performed without controlling the switch portion to switch the state of second air communication portion from the first state to the second state, wherein the specific condition includes a first condition that the residual amount of ink is smaller than the first residual amount.

3. The inkjet type image forming apparatus according to claim 2, wherein the controller is further configured to perform:

after the residual amount of ink is determined to be smaller than the first residual amount, determining whether an ejection amount is larger than or equal to a threshold value, the ejection amount is an estimated amount of ink to be ejected in the recordation process, wherein the specific condition further includes a second condition that the ejection amount is larger than or equal to the threshold value.

4. The inkjet type image forming apparatus according to claim 3, wherein the threshold value is set to selective one of a first value and a second value smaller than the first value, wherein the controller is further configured to perform:

when the residual amount of ink is smaller than the first residual amount, determining whether the residual amount of ink is smaller than a second residual amount smaller than the first residual amount; and when the residual amount of ink is greater than or equal to the first residual amount, the threshold value is set to the first value and the second condition is that the ejection amount is larger than or equal to the first value whereas when the residual amount of ink is smaller than the second threshold amount, the threshold value is set to the second value and the second condition is that the ejection amount is larger than or equal to the second value.

5. The inkjet type image forming apparatus according to claim 3, wherein the controller is further configured to perform modifying the threshold value so that when an ambient temperature of the inkjet type image forming apparatus is smaller than a threshold temperature, the threshold value is set to a value smaller than a value that is set when the temperature is greater than or equal to the threshold temperature.

6. The inkjet type image forming apparatus according to claim 3, wherein the controller is further configured to perform modifying the threshold value so that when an ambient humidity of the inkjet type image forming apparatus is smaller than a threshold humidity, the threshold value is set to a value smaller than a value that is set when the humidity is greater than or equal to the threshold humidity.

7. The inkjet type image forming apparatus according to claim 3, further comprising a sensor configured to output signals different from each other depending on whether the residual amount is smaller a threshold residual amount smaller than the first residual amount, wherein the threshold value is an amount subtracting the threshold residual amount from the residual amount.

8. The inkjet type image forming apparatus according to claim 2, further comprising:

a sensor configured to output signals different from each other depending on whether the residual amount is smaller a threshold residual amount smaller than the first residual amount; and a notification portion, wherein the controller is further configured to perform controlling the notification portion to notify that the cartridge is required to be exchanged to a new one when the detection signal is changed.

9. The inkjet type image forming apparatus according to claim 8, wherein the cartridge includes an outer surface having a visible part through which the ink stored in the first storage chamber is visible.

10. The inkjet type image forming apparatus according to claim 1, further comprising a conveying portion configured to convey the recording sheet in a conveying direction, wherein in the recording process a region of the recording sheet is divided into a plurality of sub-regions, and an image is recorded on a sub-region to sub-region basis, wherein the controller is further configured to perform:

controlling the conveying portion to convey the recording sheet in the conveying direction so that a present sub-region opposes to the recording portion, the present sub-region being a target of a next image recordation process;

specifying a residual amount of ink stored in the second storage chamber after a previous recordation process on a previous-sub region has been executed (S330);

determining whether the residual amount of ink is smaller than a first residual amount; and after the residual amount of ink is determined to be smaller than the first residual amount, determining whether an ejection amount is larger than or equal to a threshold value, the ejection amount is an estimated amount of ink to be ejected in the recordation process on the present sub-region which is recently conveyed so as to oppose to the recording portion by the conveying portion;

wherein when a specific condition is met, the recordation process on the present sub-region is executed after controlling the switch portion to switch the state of second air communication portion from the first state to the second state whereas when the specific condition is not met, the recordation process on the present sub-region is performed without controlling the switch portion to switch the state of second air communication portion from the first state to the second state, wherein the specific condition includes a first condition that the residual amount of ink is smaller than the first residual amount, and a second condition that the ejection amount is larger than or equal to the threshold value.

11. The inkjet type image forming apparatus according to claim 10, wherein the recording portion includes:

a recording head in which the nozzles are formed;

a carriage mounting the recording head and configured to move in a main scanning direction crossing the conveying direction, the inkjet type image forming apparatus further comprising:

a drive source; and a lever movable in the main scanning direction and disposed at a position shifted in the main scanning direction from a region through which the recording sheet is conveyed, wherein the switch portion switches the state of the second air communication portion between the first state and the second state by driving force transmitted from the drive source, wherein the carriage is configured to be switched between a contact state in which the carriage is in contact with the lever and a separation state in which the carriage is separate from the lever, wherein the lever is movable between a first position at which the driving force is capable of being transmitted from the drive source to the switch portion and a second position at which the driving force is not transmitted from the drive source to the switch portion, movement of the lever between the first position and the second position being made by changing a state of the carriage between the contact state and the separation state, wherein the controller is further configured to perform driving the drive source while controlling the carriage to be in the contact state, wherein the controlling the switch portion is performed after the driving is executed, wherein in the recordation process, the controller controls the recording head to eject the ink while controlling the carriage to move in the main scanning direction.

12. The inkjet type image forming apparatus according to claim 1, wherein the second air communication portion includes an air passage in which the air flows between the second storage chamber and outside of the inkjet type image forming apparatus, wherein the switch portion opens the air passage so that the state of the second air communication portion is the first state, wherein the switch portion blocks the air passage so that the state of the second air communication portion is the second state.

* * * * *